US006167672B1

(12) United States Patent
Okitomo

(10) Patent No.: US 6,167,672 B1
(45) **Date of Patent: *Jan. 2, 2001**

(54) SUPPLEMENTARY REINFORCING CONSTRUCTION FOR A REINFORCED CONCRETE PIER

(75) Inventor: Masayuki Okitomo, Futtsu (JP)

(73) Assignee: Nippon Steel Corporation, Tokyo (JP)

( * ) Notice: Under 35 U.S.C. 154(b), the term of this patent shall be extended for 0 days.

This patent is subject to a terminal disclaimer.

(21) Appl. No.: 09/434,846

(22) Filed: Nov. 4, 1999

Related U.S. Application Data

(63) Continuation of application No. 08/847,300, filed on Apr. 24, 1997, now Pat. No. 6,006,488.

(51) Int. Cl.[7] ..... E02D 5/60

(52) U.S. Cl. ..... 52/721.4; 405/216

(58) Field of Search ..... 14/75; 405/278, 405/279, 281, 231, 256, 232, 257, 211, 216; 52/170, 721.4, 723.1, 736.3, 737.4, 738.1, 248; 264/35

(56) References Cited

U.S. PATENT DOCUMENTS

| | | | | |
|---|---|---|---|---|
| 2,191,248 | * | 2/1940 | Cappel | 405/216 |
| 3,355,852 | * | 12/1967 | Lally | 52/721.4 |
| 4,023,374 | * | 5/1977 | Colbert et al. | 405/216 |
| 4,071,996 | * | 2/1978 | Muto et al. | 52/721.4 X |
| 4,211,503 | * | 7/1980 | Peterson et al. | 405/216 X |
| 4,439,070 | * | 3/1984 | Dimmick | 405/216 |
| 4,445,806 | * | 5/1984 | Crain | 405/216 |
| 5,435,667 | * | 7/1995 | Strange | 405/216 |
| 5,713,701 | * | 2/1998 | Marshall | 405/232 |

* cited by examiner

*Primary Examiner*—Eileen D. Lillis
*Assistant Examiner*—Sunil Singh
(74) *Attorney, Agent, or Firm*—Kenyon & Kenyon

(57) ABSTRACT

A supplemental reinforcing structure for supplementally reinforcing an existing reinforced concrete pier and a reinforced concrete pier reinforcing method facilitating and simplifying field work, and capable of saving time and labor necessary for field work and of improving the quality and reliability of field work. A closed steel plate structure is constructed so as to surround a reinforced concrete pier with a space formed between the closed steel plate structure by connecting a plurality of steel elements including flat steel elements (6) having longitudinal mating edge portions (5) for forming mechanical joints and angular steel elements (7) having longitudinal mating edge portions (5) for forming mechanical joints and a shape resembling an angle iron. The mating edge portions (5) of the adjacent steel plates (6, 7) are joined together to connect the adjacent steel plates (6, 7). A freely formable hardening material is filled in the space and is made to harden therein. Since the steel elements (6, 7) are firmly connected together by mechanically joining together the adjacent mating edge portions (5) without requiring welding, field work is facilitated and simplified, and the steel elements may be made of a corrosion-resistant metal or may be formed by processing surface-treated metal plates.

8 Claims, 24 Drawing Sheets

Fig. 23

| | TABLE OF THE VARIOUS MATING JOINTS |
|---|---|
| a | |
| b | |
| c | |
| d | |
| e | |
| f | |
| g | |

SUPPLEMENTARY REINFORCING CONSTRUCTION FOR A REINFORCED CONCRETE PIER

This application is a continuation application under 37 C.F.R. §1.53(b) of prior application Ser. No. 08/847,300 filed Apr. 24, 1997. The disclosure of the specification, claims, drawings and abstract of application Ser. No. 08/847,300 is incorporated herein by reference, now U.S. Pat. No. 6,006,488.

BACKGROUND OF THE INVENTION

1. Field of the Invention

The present invention relates to a reinforcing structure for reinforcing reinforced concrete piers in the civil engineering industry, the harbor industry and the building industry, and a method of reinforcing such reinforced concrete piers. More particularly, the present invention relates to a reinforcing structure for reinforcing reinforced concrete piers wrapped with high-performance, labor-saving steel plates which enhance the functions of earthquake-resisting hoops, and a method of reinforced concrete piers.

2. Description of the Related Art

Reinforced concrete piers which failed during the Kobe earthquake have taught that the hoop density, i.e., the number of hoops per unit length, of existing reinforced concrete piers is far less than that necessary to secure satisfactory earthquake resistance. Recently, a method of reinforcing existing reinforced concrete piers by wrapping the same with steel plates has been seen as prospective means for enhancing the earthquake resistance of existing reinforced concrete piers.

Referring to FIG. 24 showing a supplemental reinforcing structure for reinforcing an existing reinforced concrete pier, using wrapping steel plates, a reinforced concrete pier 52 provided with a plurality of longitudinal main reinforcing bars 50 and lateral hoops 51 is wrapped with steel plates with a space between the surface of the reinforced concrete pier and the steel plates. The steel plates includes flat steel plates 53 for covering flat portions of the surface of the reinforced concrete pier 52, and angular bent steel plates 54 having a cross section resembling the letter L, for covering the corner edge portions of the reinforced concrete pier 52. The respective edges of the flat steel plates 53 and the adjacent angular steel plates 54 are welded together by seam welding. The space between the reinforced concrete pier 52 and the steel plates 53 and 54 of the supplemental reinforcing structure is filled up with a freely formable hardening material 55, such as mortar. In FIG. 24, backing strips are indicated at 56.

This conventional supplemental reinforcing structure using the steel plates as shown in FIG. 24, however, is subject to circumferential tension, needs field seam welding and has the following disadvantages.

The reliability of the quality of welded portions of the steel plates of the supplemental reinforcing structure formed by seam welding at site is uncertain, field welding needs temporary work and large-scale scaffolding, requires troublesome work and increases costs.

The tendency of weld quality to deteriorate becomes more conspicuous if a corrosion-resistant metal, such as a stainless steel, or a high-strength steel is used.

If surface-treated steel plates, such as plated steel plates or coated steel plates, are used, corrosion proofing measures including pretreatment for the surface-preparation of the surfacing material in portions of the steel plates to be welded, and field posttreatment for touch-up painting and the like are necessary, and troublesome field work is unavoidable.

SUMMARY OF THE INVENTION

Accordingly, it is a principal object of the present invention to provide a supplemental reinforcing structure of a reinforced concrete pier, capable of solving the foregoing problems in the conventional techniques, and a method of supplementally reinforcing a reinforced concrete pier.

Another object of the present invention is to provide a supplemental reinforcing structure of a reinforced concrete pier and a method of supplementally reinforcing a reinforced concrete pier, using, as reinforcing steel plates, steel elements having mechanical mating edge portions which can be joined together without requiring welding, capable of facilitating and simplifying field work for reinforcing a reinforced concrete pier with the supplemental reinforcing structure at site, of reducing time and labor. necessary for the field work and of improving the quality and reliability of field work, and a method of supplementally reinforcing a reinforced concrete pier, using the supplemental reinforcing structure.

With the foregoing object in view, the present invention provides a supplemental reinforcing structure for a reinforced concrete pier, comprising a closed steel plate structure of steel elements having mating edge portions and serving as steel plates, formed by joining together the adjacent mating edge portions so as to surround the reinforced concrete pier with a space formed between the reinforced concrete pier and the closed steel plate structure; and a freely formable hardening material filling up and hardened in the space between the reinforced concrete pier and the closed steel plate structure.

The use of the steel elements having the mechanical mating edge portions as the component steel plates of the supplemental reinforcing structure of a reinforced concrete pier facilitates and simplifies the field work, the mechanical mating edge portions not requiring field welding, save labor and time necessary for the field work, and improve the quality and reliability remarkably.

The steel elements having the mating edge portions may be made of a corrosion-resistant metal.

The steel elements having the mating edge portions may be made from surface-treated metal plates.

Since the steel elements can be connected by joining together the adjacent mating edge portions without requiring welding, the steel elements can be made of a corrosion-resistant metal or can be made from surface-treated metal plates.

A portion of the steel plate is a halved steel sheet pile having a mating edge portion only in one edge portion thereof, i.e., a steel element obtained by cutting a steel sheet pile in half along the longitudinal center line thereof, and the halved steel sheet pile serves as a joining steel plate.

The steel element having the mating edge portions may be formed from only a steel sheet pile.

If a portion of a steel sheet pile or an entire steel sheet pile is used as the steel element having the mating edge portions, the quantity of secondary work for processing steel plates is reduced for further rationalization.

The steel elements having the mating edge portions may be placed in a zigzag arrangement across an upper and a lower reinforcing structure.

The zigzag arrangement of the steel elements prevents the horizontal displacement of the upper and the lower supplemental reinforcing structure, and a circumferential tensile load is distributed evenly to the upper and the lower supplemental reinforcing structure, so that the supplemental reinforcing structures can further be strengthened.

The present invention also provides a method of supplementally reinforcing a reinforced concrete pier, comprising constructing a closed steel plate structure by connecting steel elements having mating edge portions by joining together the adjacent mating edge portions so as to surround the reinforced concrete pier with a space formed between the reinforced concrete pier and the closed steel plate structure; and filling up the space between the reinforced concrete pier and the closed steel plate structure with a freely formable hardening material and making the amorphous material harden in the space.

The present invention further provides a method of supplementally reinforcing a reinforced concrete pier, comprising constructing a closed steel plate structure by connecting steel elements having mating edge portions by joining together the adjacent mating edge portions so as to surround the reinforced concrete pier with a space formed between the reinforced concrete pier and the closed steel plate structure; pretensioning the joints formed by joining together the adjacent mating edge portions of the steel elements to eliminate joint clearances in the joints; and filling up the space between the reinforced concrete pier and the closed steel plate structure with a freely formable hardening material and making the amorphous material harden in the space.

A reliable supplemental reinforcing structure can be constructed by eliminating joint clearances in the joints of the steel elements, filling up the space between the reinforced concrete pier and the closed steel plate structure with the freely formable hardening material and making the amorphous hardening material harden in the space.

BRIEF DESCRIPTION OF THE DRAWINGS

The above and other objects, features and advantages of the present invention will become more apparent from the following description taken in connection with the accompanying drawings, in which

FIG. 23 is a table of possible mating joints of steel elements; and

DESCRIPTION OF THE PREFERRED EMBODIMENTS

Figure 1:
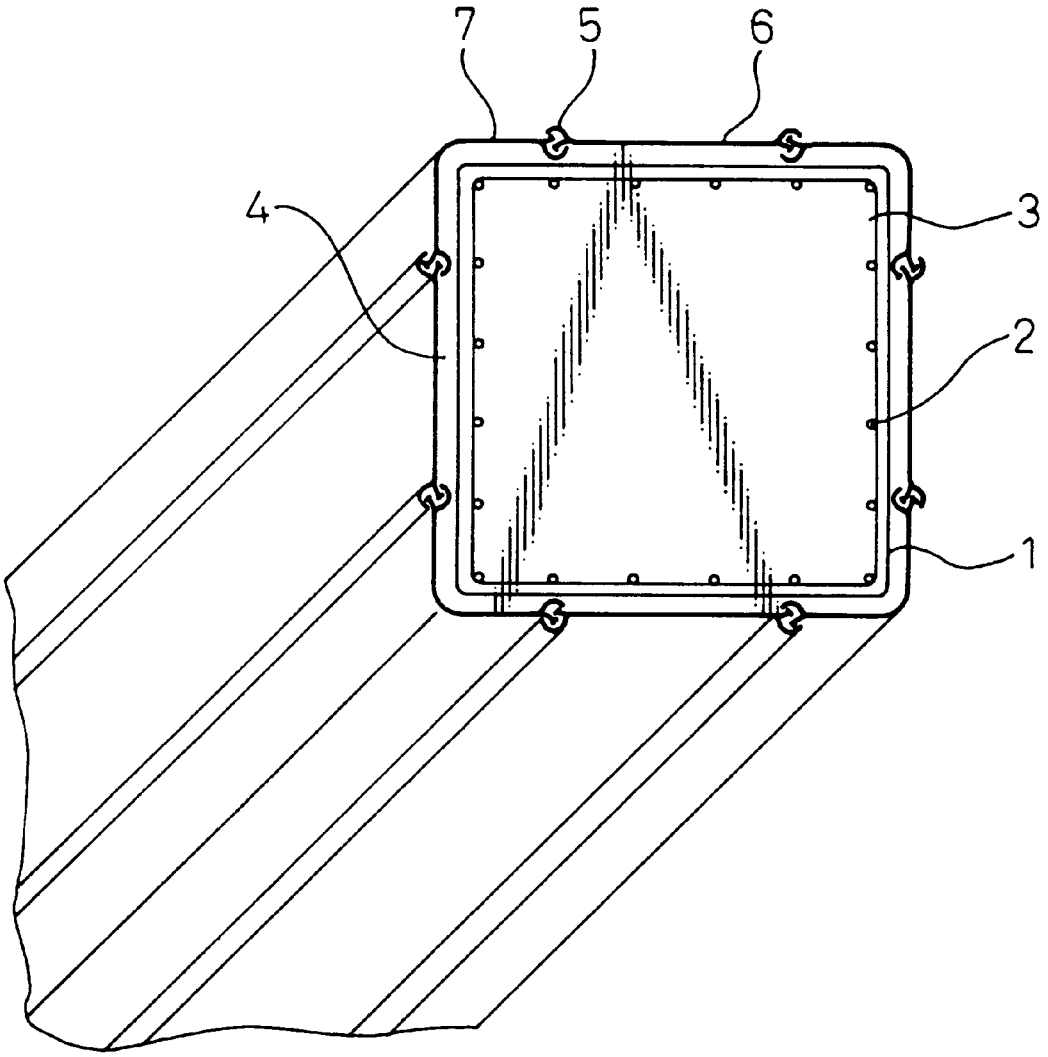
FIG. 1 is a perspective view of a supplemental reinforcing structure in a first embodiment according to the present invention for supplementally reinforcing a reinforced concrete pier.

FIG. 1 shows a supplemental reinforcing structure in a first embodiment according to the present invention for reinforcing an existing reinforced concrete pier 1 provided with a plurality of longitudinal main reinforcements 2 and a plurality of circumferential hoops 3. A steel plate structure is constructed so as to surround the reinforced concrete pier 1 so that a space is formed between the steel plates structure and the reinforced concrete pier 1. The steel plate structure includes steel elements similar to steel sheet piles each having longitudinal mating edge portions 5 for a mechanical joint. More specifically, the steel plate structure comprises flat steel elements 6, i.e., flat steel sheet piles, having longitudinal mating edge portions 5, for covering the flat surfaces of the reinforced concrete pier 1, and angular steel elements 7 having a cross section resembling the letter L and longitudinal mating edge portions 5, for covering the corner edge portions of the reinforced concrete pier 1. The adjacent mating edge portions 5 of the steel elements 6 and 7 are mechanically fixedly joined together. A freely formable hardening material 4, such as mortar or a resin, is filled in the space formed between the reinforced concrete pier 1 and the steel plate structure consisting of the steel elements 6 and 7, and is made to harden therein. Preferably, the freely formable material is a noncotracting material which expands slightly when it hardens.

Since the adjacent steel elements 6 and 7 can be mechanically and firmly connected by joining together the mating edge portions 5, the steel elements 6 and 7 may be made of a corrosion-resistant metal, such as a stainless steel, or a high-strength steel which is difficult to weld satisfactorily, and the steel elements 6 and 7 may be surface-treated metal plates having surfaces plated with zinc or coated with a coating material.

The steel elements 6 and 7 similar to steel sheet piles reduce the quantity of secondary work for processing steel plates for further rationalization.

Figure 2:
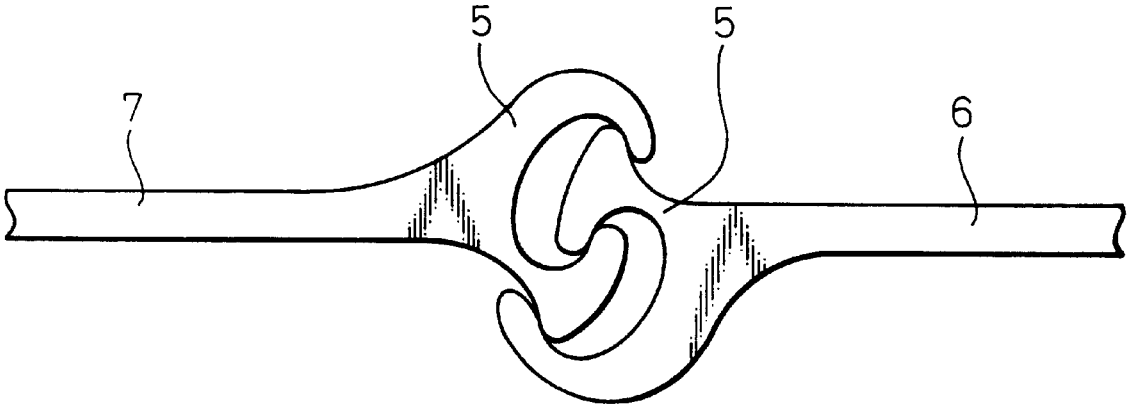
FIG. 2 is an enlarged view of a mating joint employed in the supplemental reinforcing structure of FIG. 1.

FIG. 2 shows the mating edge portions 5 of the flat steel element 6 and the angular steel element 7 in an enlarged view. The mating edge portions 5 of the flat steel element 6 and the angular steel element 7 are engaged to form a joint. When engaging the mating edge portions 5, the flat steel element 6 is raised so that the lower end of the flat steel element 6 is raised to the level of the upper end of the angular steel element 7, the lower end of the ridge portion of the mating edge portion 5 of the flat steel element 6 is aligned with the upper end of the groove of the mating edge portion 5 of the angular steel element 7, and the upper end of the ridge portion of the mating edge portion 5 of the angular steel element 7 is aligned with the lower end of the groove of the mating edge portion 5 of the flat steel element, and then the flat steel element 6 is lowered so that the respective ridge portions of the mating edge portions of the flat steel element 6 and the angular steel element 7 are inserted in the respective grooves of the angular steel element 7 and the flat steel element 6, respectively.

A method of supplementally reinforcing the reinforced concrete pier 1 by using the supplemental reinforcing structure of FIG. 1 will be described hereinafter.

The mating edge portions 5 of the flat steel elements 6 and the adjacent mating edge portions 5 of the angular steel elements 7 are engaged sequentially so as to arrange the flat steel elements 6 and the angular steel elements 7 alternately around the reinforced concrete pier 1 to construct the reinforcing steel plate structure surrounding the reinforced concrete pier 1. Then, the freely formable hardening material 4, such as mortar or a resin, is poured into the space between the steel plate structure and the reinforced concrete pier 1 and the freely formable hardening material 4 is made to harden in the space to complete the supplemental reinforcing structure.

Generally, a proper joint clearance needs to be secured in the mating joint to form the mating joint properly and to absorb dimensional errors in the steel elements 6 and 7. Such a joint clearance is not desirable because the joint clearance reduces the initial rigidity and the reinforcing effect of the steel plate structure. A method proposed to avoid the reduction of the initial rigidity and the reinforcing effect of the steel plate structure injects mortar or a resin into the joint clearance, which, however, requires complex work, is unable to achieve reliable work and increases the costs of the supplemental reinforcing structure.

A method of properly engaging the mating edge portions 5 pretensions the joints formed by engaging the mating edge portions 5 after constructing the steel plate structure in a rectangular; circular or elliptic cross section around the reinforced concrete pier 1 so that the clearances in the joints are eliminated and the rigidity of the joints may not be reduced, and then the freely formable hardening material 4 is filled in the space and is made to harden therein to construct the supplemental reinforcing structure to reliably reinforce the existing reinforced concrete pier 1.

A method of pretensioning the joint attaches tensioning devices to portions of the adjacent flat steel element 6 and the angular steel element 7 near the joint, and pulls the flat steel element 6 and the angular steel element 7 away from each other by the tensioning devices. Another method of pretensioning the joint attaches tensioning devices to portions of the adjacent flat steel element 6 and the angular steel element 7 near the joint, and applies a pressure by the tensioning devices to the reinforced concrete pier 1 to expand the reinforcing steel plate structure of the steel elements 6 and 7 by the reactive force of the reinforced concrete pier 1 acting on the tensioning devices. The former method of pretensioning the joint will be described hereinafter.

Figure 3:
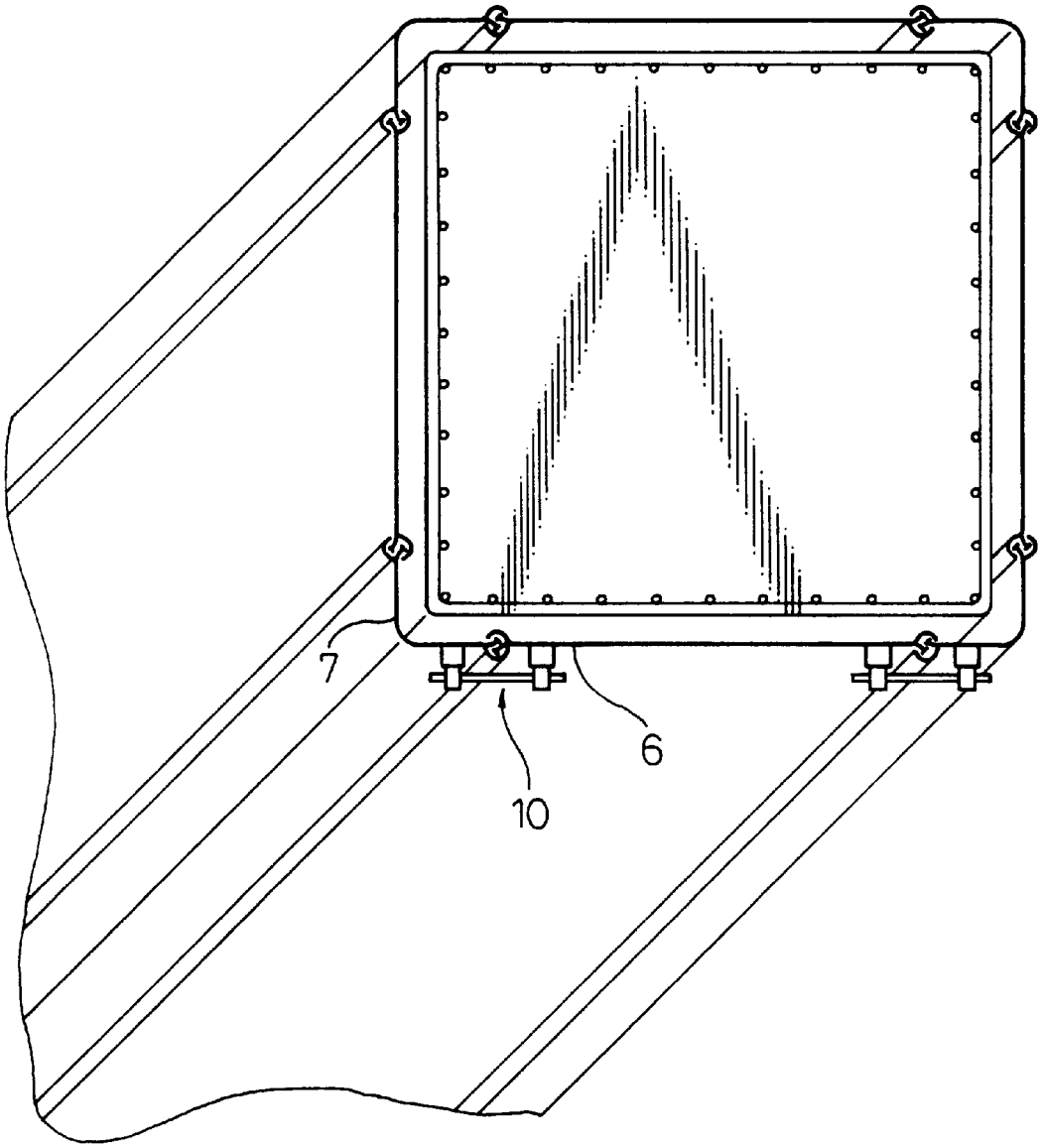
FIG. 3 is a perspective view, similar to FIG. 1, of assistance in explaining a reinforcing method using a pretensioning device.
Figure 4:
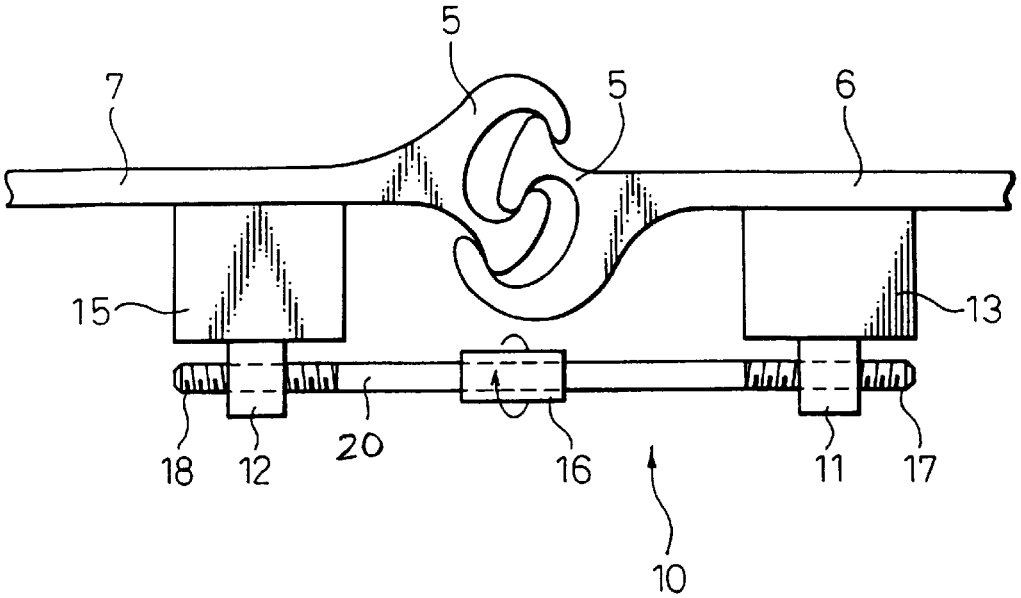
FIG. 4 is an enlarged view of the pretensioning device shown in FIG. 3.

FIG. 3 is a view of assistance in explaining the former method of pretensioning the joint by pretensioning devices attached to the portions of the steel elements 6 and 7 near the joint, and FIG. 4 is an enlarged view of the pretensioning device, in which parts like or corresponding to those described with reference to FIGS. 1 and 2 are designated by the same reference characters and the description thereof will be omitted to avoid duplication, which applies to the description of other embodiments which will be given later.

Referring to FIG. 4, a pretensioning device 10 includes anchor blocks 13 and 15, tapped blocks 11 and 12 attached to the anchor blocks 13 and 15, and provided with internally threaded holes provided with internal threads of opposite hands, respectively, and a rod 20 having a middle grip section and threaded sections 17 and 18 provided with external threads of opposite hands, respectively. The threaded sections 17 and 18 of the rod 20 are screwed in the internally threaded holes of the tapped blocks 11 and 12. The rod 20 is gripped in its grip section and is turned clockwise or counterclockwise to move the anchor blocks 13 and 15 away from each other. The anchor blocks 13 and 15 are fixed to the steel elements 6 and 7, respectively, with magnets or an adhesive.

A supplemental reinforcing method using the supplemental reinforcing structure will be described hereinafter.

The steel elements 6 and 7 having the mating edge portions 5 are connected by joining the adjacent mating edge portions 5 to construct the reinforcing steel plate structure around the reinforced concrete pier 1 so that the space is formed between the reinforcing steel plate structure and the reinforced concrete pier 1, and then the anchor blocks 13 and 15 are fixed to portions of the steel elements 6 and 7 near the joints with magnets or an adhesive. The rods 20 of the pretensioning devices are gripped in their grip sections and the rods 20 are turned to pull the adjacent steel elements 6 and 7 away from each other to eliminate the joint clearances between the mating edge portions 5 of the joints. The rods 20 are turned further in the same direction to pretension the mating edge portions 5 to a degree which will not reduce the rigidity of the mating edge portions, and the freely formable hardening material 4 is filled in the space between the reinforced concrete pier 1 and the reinforcing steel plate structure formed by connecting the steel elements 6 and 7, and is made to harden in the space.

The latter pretensioning method using the latter pretensioning devices will be described hereinafter.

Figure 5:
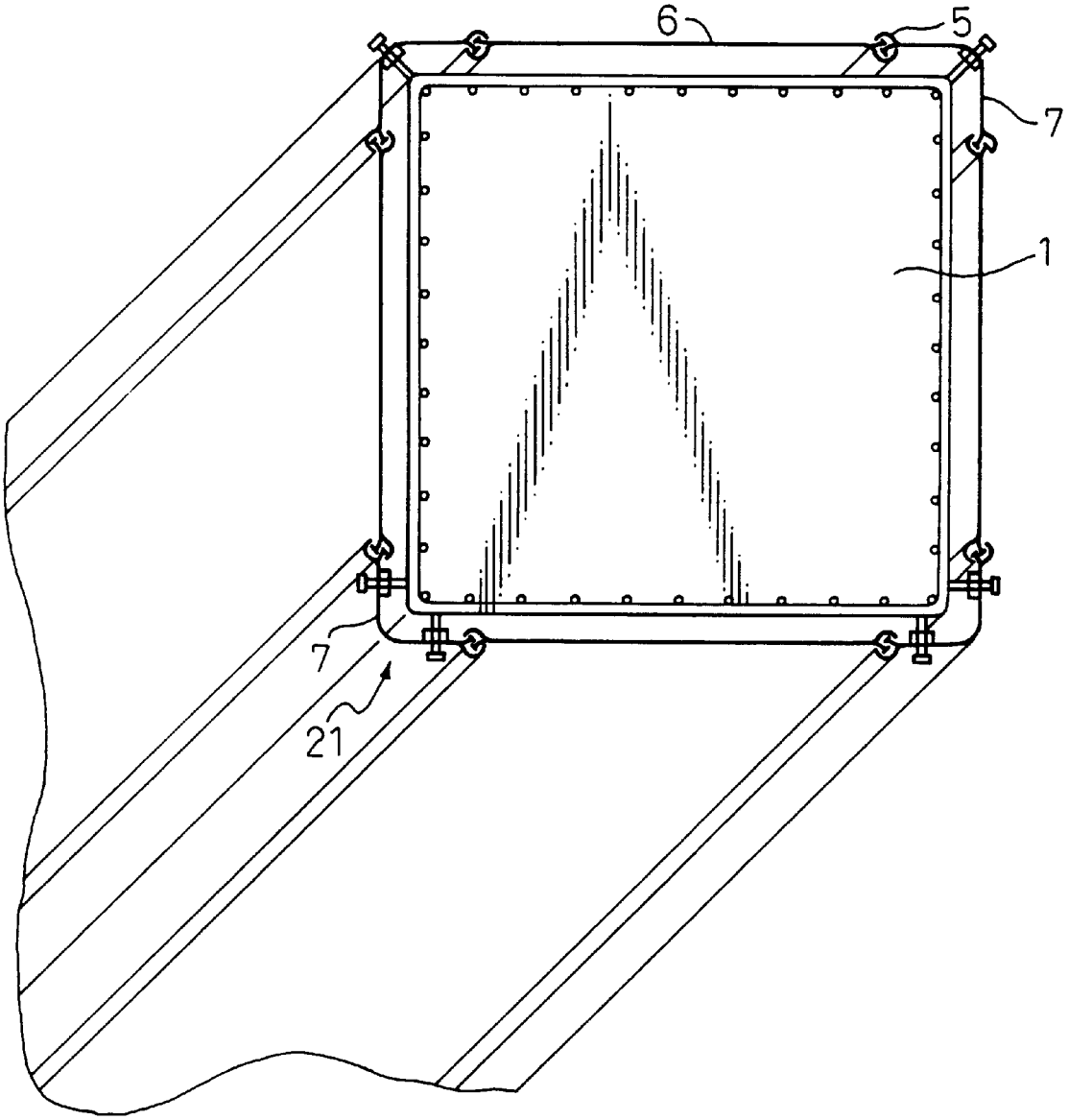
FIG. 5 is a perspective view, similar to FIG. 1, of assistance in explaining a reinforcing method using another pretensioning device.
Figure 6:
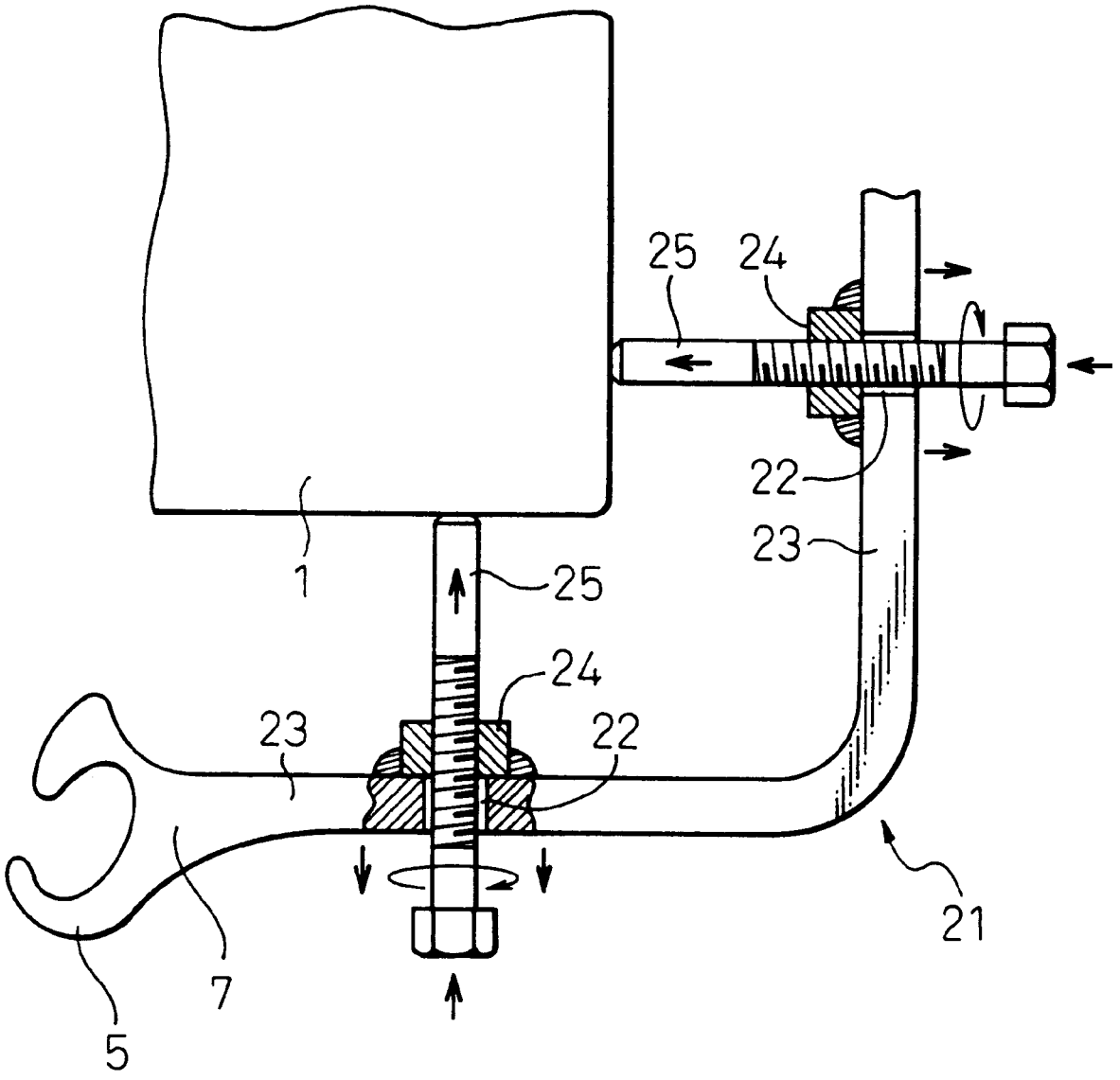
FIG. 6 is an enlarged view of the pretensioning device shown in FIG. 5.

FIG. 5 is a view of assistance in explaining the latter method of pretensioning the joint by the latter pretensioning device, and FIG. 6 is an enlarged view of the pretensioning devices.

The pretensioning device 21 includes a pair of nuts 24 welded to the inner surfaces of flat portions 23 of the angular steel element 7 having the shape of an angle iron in alignment with a pair of openings 22 formed in the flat portions, respectively, and a pair of long bolts 25 screwed in the pair of nuts 24, respectively.

The long bolts 25 are turned to bring their tips into contact with the surface of the reinforced concrete pier 1 and are turned further after the tips thereof have been brought into contact with the reinforced concrete pier 1. Then, reactive force of the reinforced concrete pier 1 acts through the long bolts 25 on the angular steel element 7 to push the angular steel element 7 away from the reinforced concrete pier 1 as indicated by the arrows, whereby joint clearances in the joints of the mating edge portions 5 of the angular steel element 7 and the adjacent flat steel elements 6 are eliminated and the joints are pretensioned.

A supplemental reinforcing method using the supplemental reinforcing structure will be described hereinafter.

The steel elements 6 and 7 having mating edge portions 5 are connected by joining the adjacent mating edge portions 5 to construct the reinforcing steel plate structure around the reinforced concrete pier 1 so that the space is formed between the reinforcing steel plate structure and the reinforced concrete pier 1, and then the pairs of bolts 25 are turned to bring their tips into contact with the surface of the reinforced concrete pier 1 and are turned further after the tips thereof have been brought into contact with the reinforced concrete pier 1. Then, reactive force of the reinforced concrete pier 1 acts through the long bolts 25 on the angular steel elements 7 to push the angular steel elements 7 away from the reinforced concrete pier 1 as indicated by the arrows in FIG. 6, whereby joint clearances in the joints of the mating edge portions 5 of the angular steel elements 7 and the adjacent flat steel elements 6 are eliminated and the joints are pretensioned. The bolts 25 are turned so that the joints are properly pretensioned and the rigidity of the mating edge portions 5 may not be reduced, and then the freely formable hardening material 4 is filled in the space between the reinforced concrete pier 1 and the reinforcing steel plate structure formed by connecting the steel elements 6 and 7, and is made to harden in the space to complete the supplemental reinforcing structure.

Figure 7:
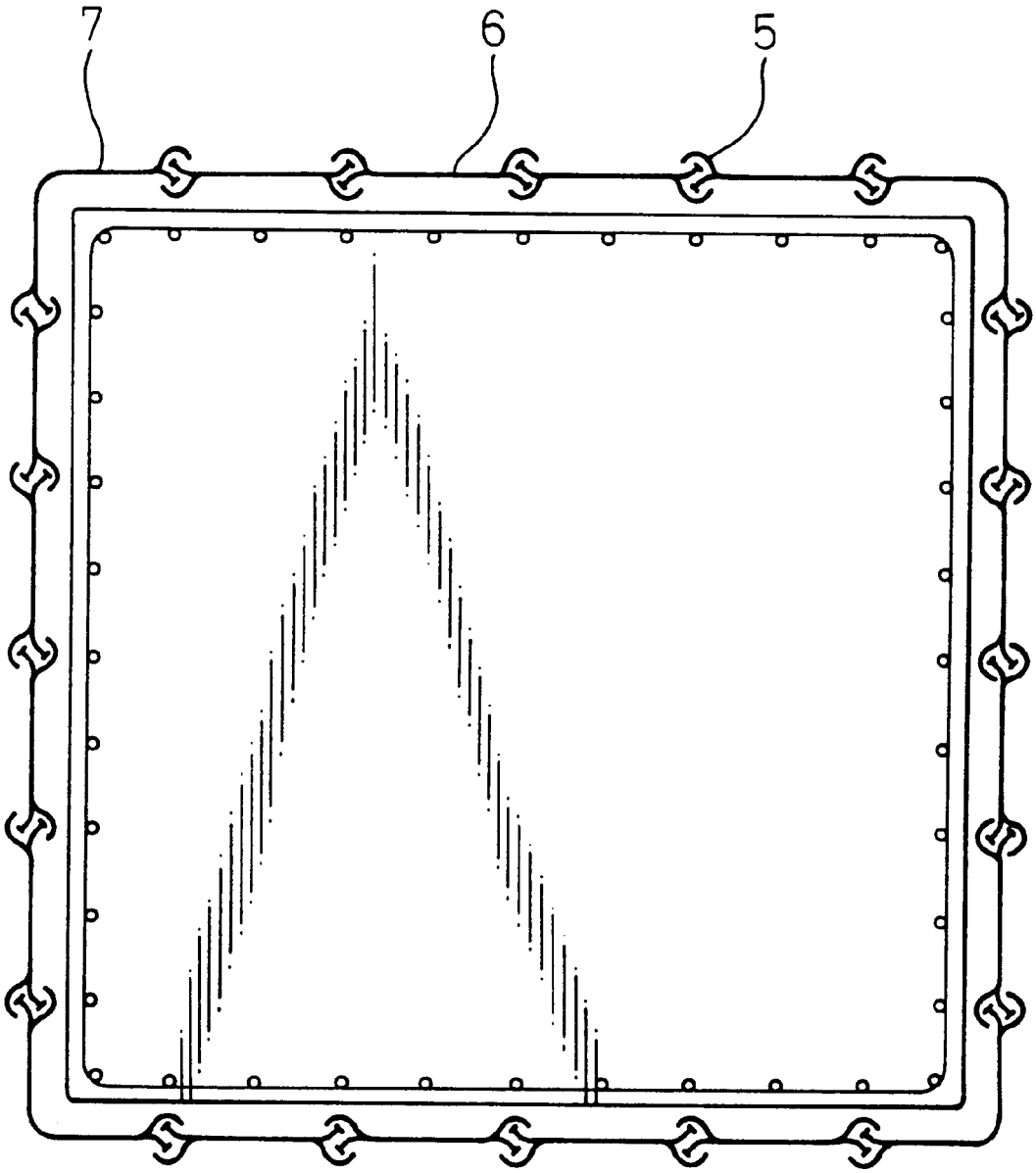
FIG. 7 is a plan view of a supplemental reinforcing structure in a second embodiment according to the present invention.

FIG. 7 is a plan view of a supplemental reinforcing structure in a second embodiment according to the present invention. The supplemental reinforcing structure in the second embodiment is intended to supplementally reinforce a large reinforced concrete pier 1. A plurality of flat steel elements 6, which are similar to the flat steel elements 6 of the first embodiment, are connected successively for each side surface of the large reinforced concrete pier 1.

Figure 8:
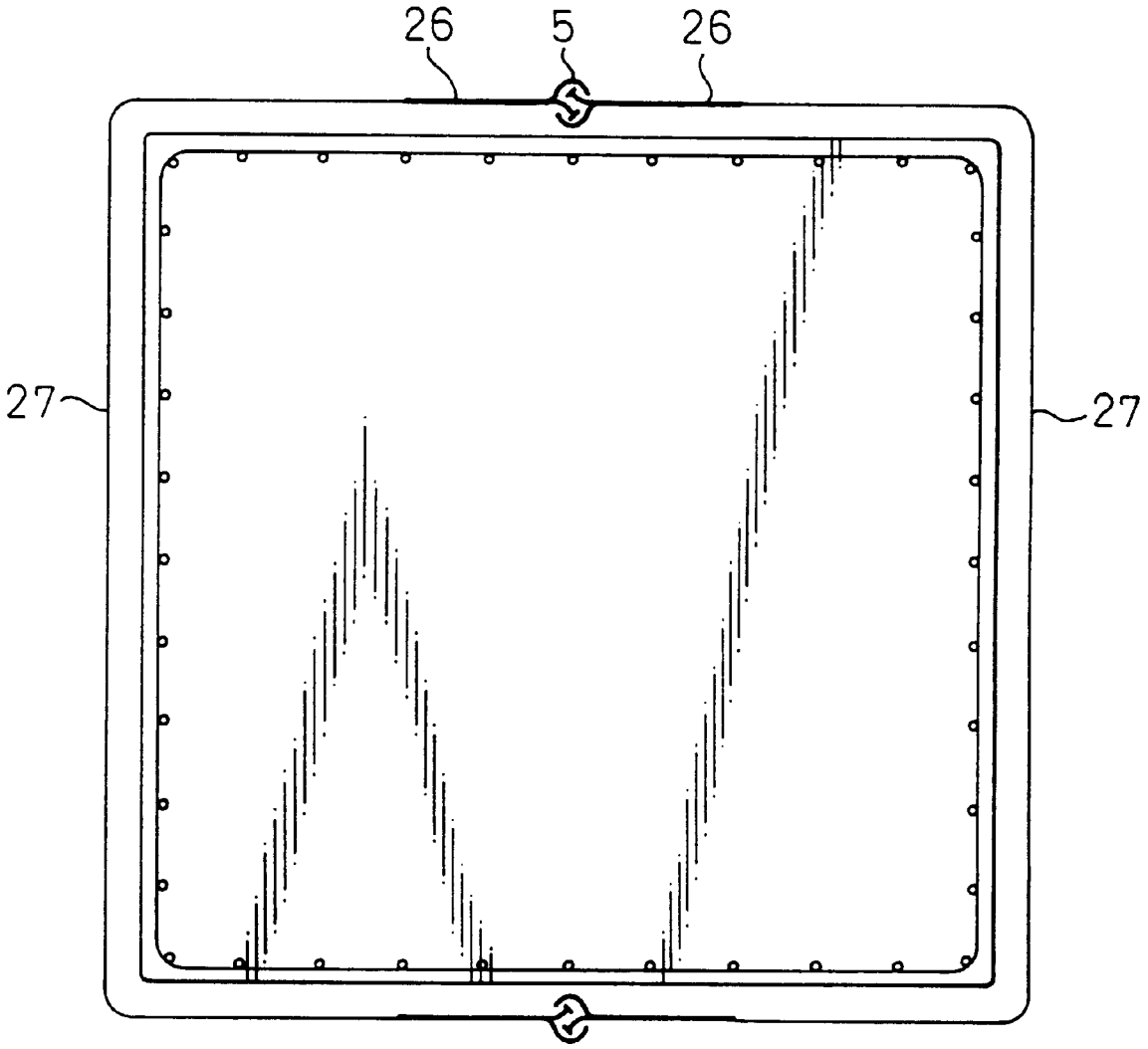
FIG. 8 is a plan view of a supplemental reinforcing structure in a third embodiment according to the present invention.

Referring to FIG. 8 showing a supplemental reinforcing structure in a third embodiment according to the present invention, the supplemental reinforcing structure includes two pairs of halved steel sheet piles 26 each having a mating edge portion 5 formed in one of the edges thereof, and steel plates 27 each welded to the edges of each pair of halved steel sheet piles 26. Each halved steel sheet pile 26 is similar to a half of a steel sheet pile obtained by cutting the steel sheet pile into halves along its center line. The steel plate 27 may be welded to the edges of the steel elements 26 in a welding shop. Since the halved steel sheet pile 26 of the third embodiment is a portion of a steel sheet pile, the quantity of secondary work for processing steel plates is reduced for further rationalization.

Figure 9:
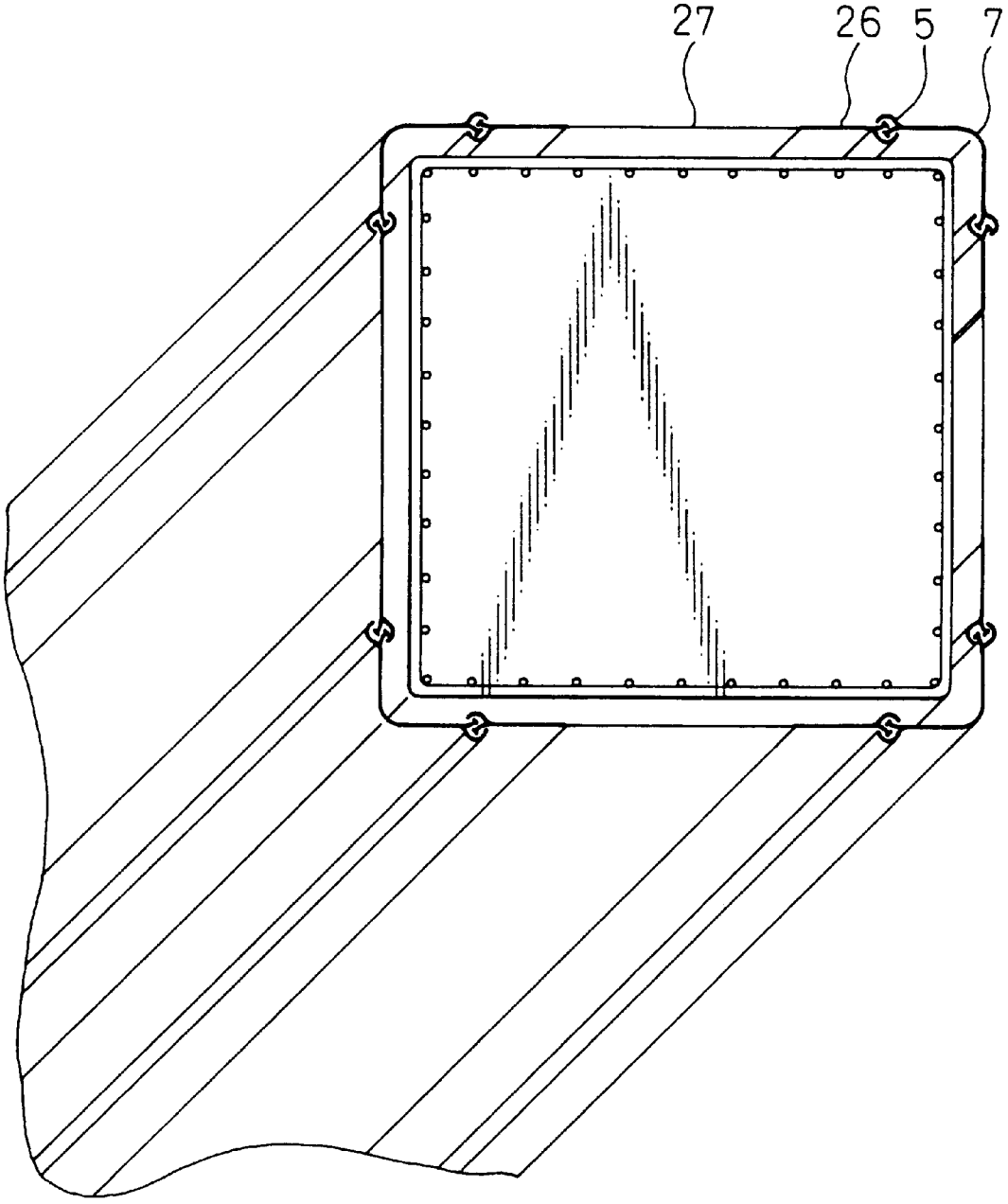
FIG. 9 is a plan view of a supplemental reinforcing structure in a fourth embodiment according to the present invention.

FIG. 9 is a perspective view of a supplemental reinforcing structure in a fourth embodiment according to the present invention. In this embodiment, each of the flat surfaces of a reinforced concrete pier 1 is covered with a steel element formed by welding together a half steel sheet pile 26, i.e., a steel plate having a mating edge portion only in one edge portion thereof obtained by cutting a steel sheet pile in half along its longitudinal center line, and a flat steel plate 27, and each of the corner edge portions of the reinforced concrete pier 1 is covered with an angular steel element 7 having the shape of an angle iron. The functions and effects of the fourth embodiment are the same as those of the third embodiment.

Figure 10:
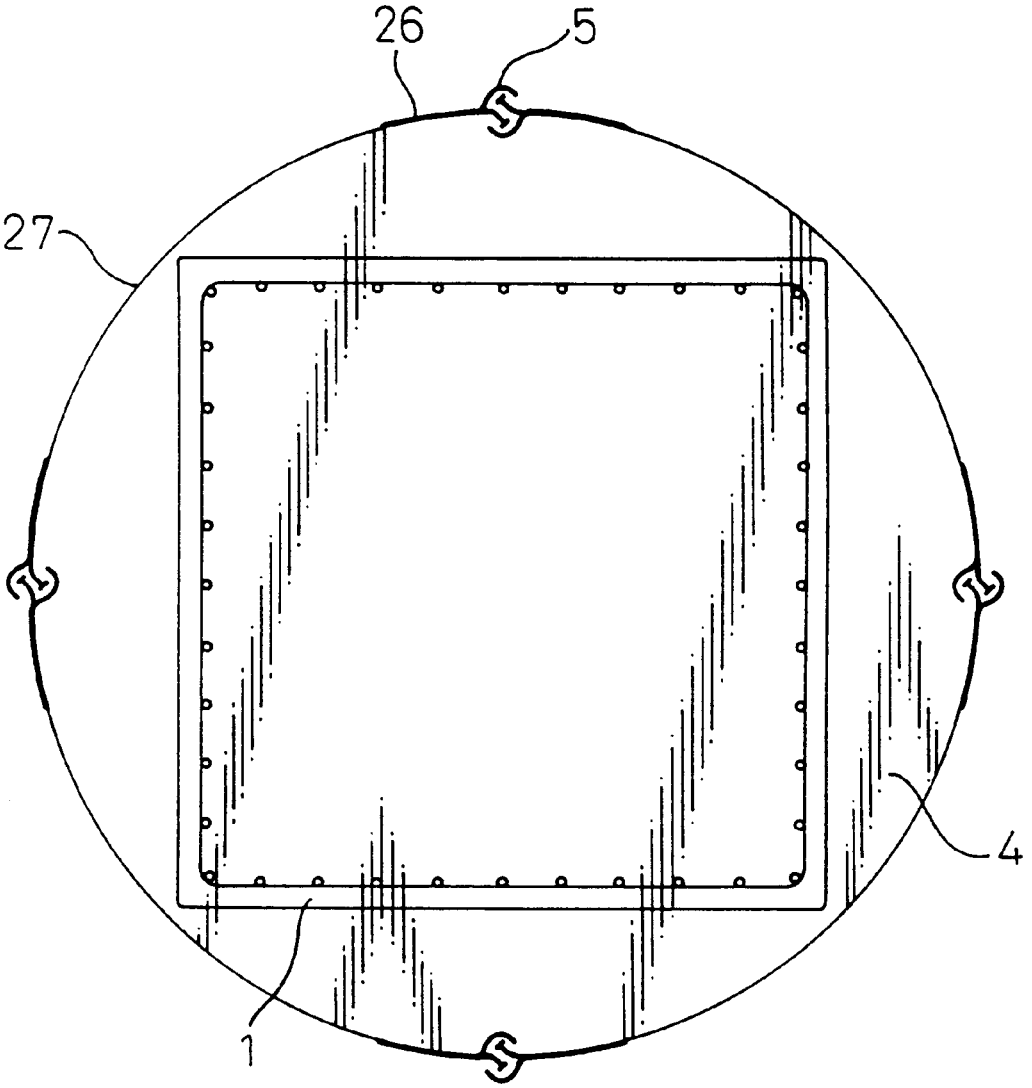
FIG. 10 is a plan view of a supplemental reinforcing structure in a fifth embodiment according to the present invention.

FIG. 10 is a plan view of a supplemental reinforcing structure in a fifth embodiment according to the present invention. A cylindrical steel plate structure is constructed by connecting steel elements each formed by welding halved steel sheet piles 26 each having a mating edge portion 5 to the opposite side edges of a steel plate 27 so as to surround a reinforced concrete pier 1 of a rectangular cross section, and filling up a space formed between the reinforced concrete pier 1 and the steel plate structure with a freely formable hardening material 4, such as mortar or a resin, and making the freely formable hardening material 4 harden in the space. The halved steel sheet piles 26 are connected by joining together their mating edge portions 5. The halved steel sheet piles 26 are welded to the steel plate 27 in a welding shop.

Figure 11:
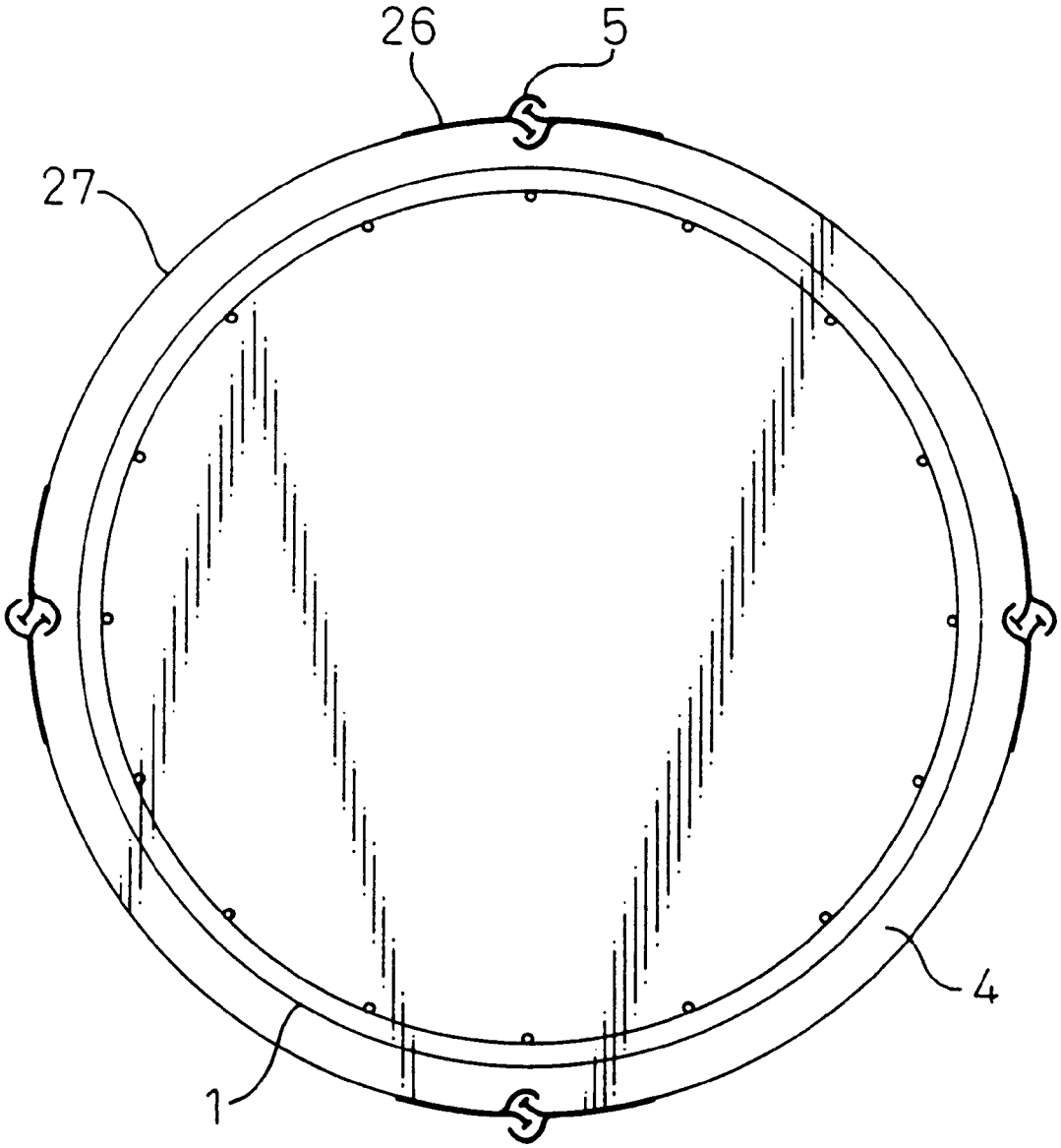
FIG. 11 is a plan view of a supplemental reinforcing structure in a sixth embodiment according to the present invention.

FIG. 11 is a plan view of a supplemental reinforcing structure in a sixth embodiment according to the present invention. A cylindrical steel plate structure is constructed by connecting steel elements each formed by welding halved steel sheet piles 26 each having a mating edge portion 5 to the opposite side edges of a steel plate 27 so as to surround a cylindrical reinforced concrete pier 1, and filling up an annular space formed between the reinforced concrete pier 1 and the steel plate structure with a freely formable hardening material 4, such as mortar or a resin, and making the freely formable hardening material 4 harden in the space. The halved steel sheet piles 26 are connected by joining together their mating edge portions 5. The halved steel sheet piles 26 are welded to the steel plate 27 at a welding shop.

Figure 12:
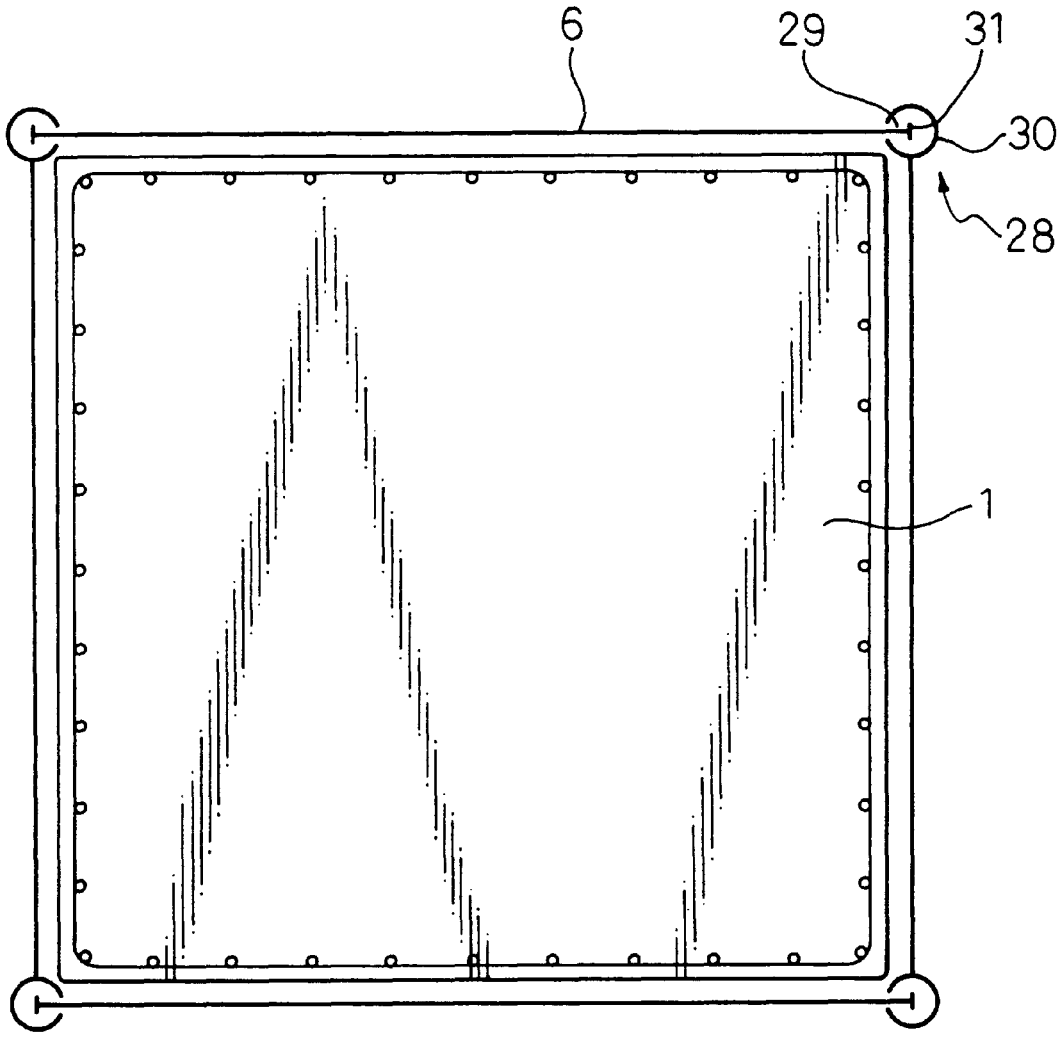
FIG. 12 is a plan view of a supplemental reinforcing structure employing another mating joint.

FIG. 12 is a plan view of a supplemental reinforcing structure employing another mating joint 28. The mating joint 28 has a female component 30 having the shape of a pipe of a circular cross section provided with a longitudinal slit, and a male component 31 having a T-shaped cross section. The supplemental reinforcing structure is constructed by connecting flat steel elements 6 each provided in its opposite longitudinal edge portions with the female components, and flat steel elements 6 each provided in its opposite longitudinal edge portions with the male components 31. The flat steel elements 6 are similar to, for example, a straight steel sheet pile.

Figure 13:
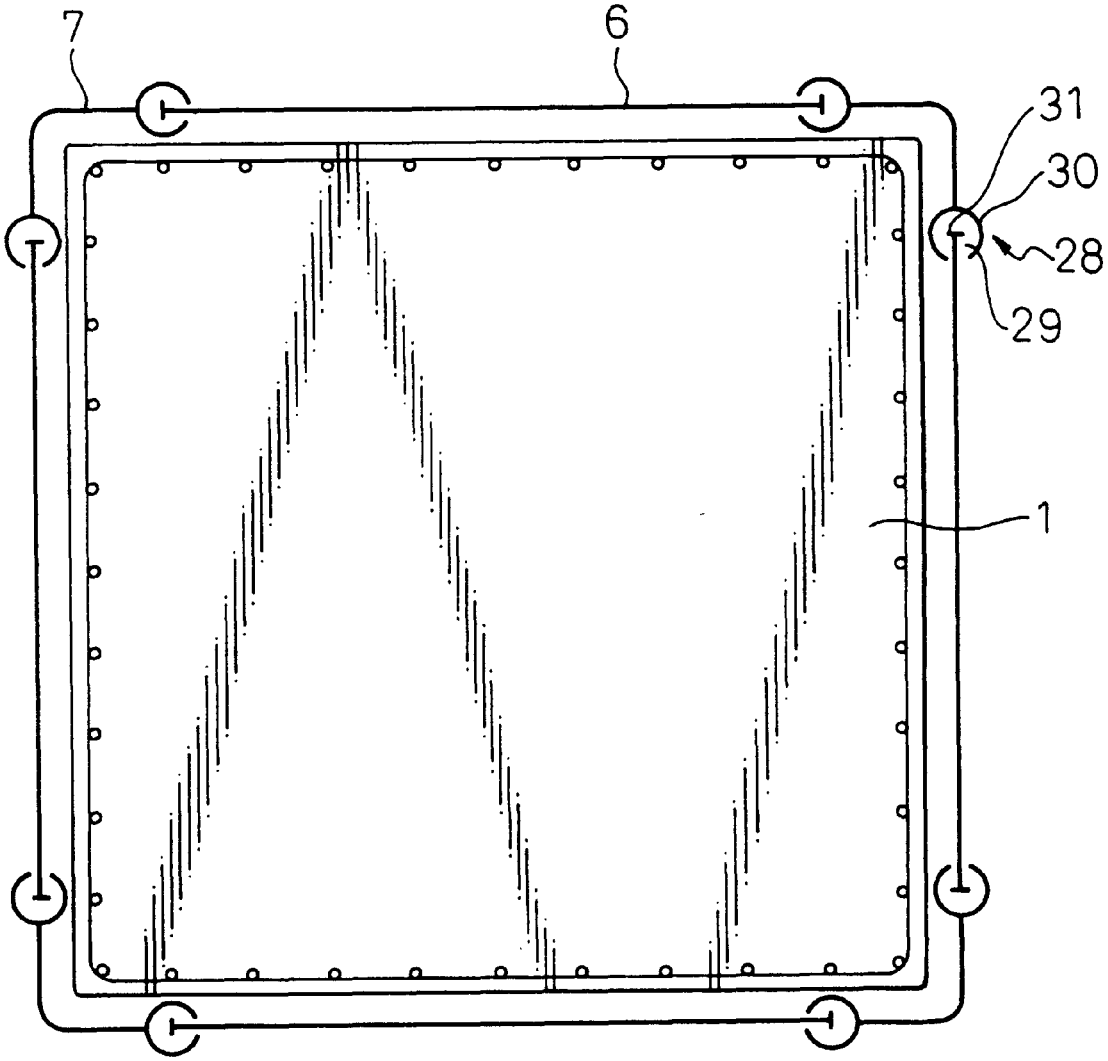
FIG. 13 is a plan view of a supplemental reinforcing structure employing the mating joint shown in FIG. 12.

FIG. 13 is a plan view of a supplemental reinforcing structure employing the mating joint 28 shown in FIG. 12. The supplemental reinforcing structure shown in FIG. 13 employs the mating joints 28 shown in FIG. 12 instead of the mating joints employed in the first embodiment shown in FIG. 1.

Figure 14:
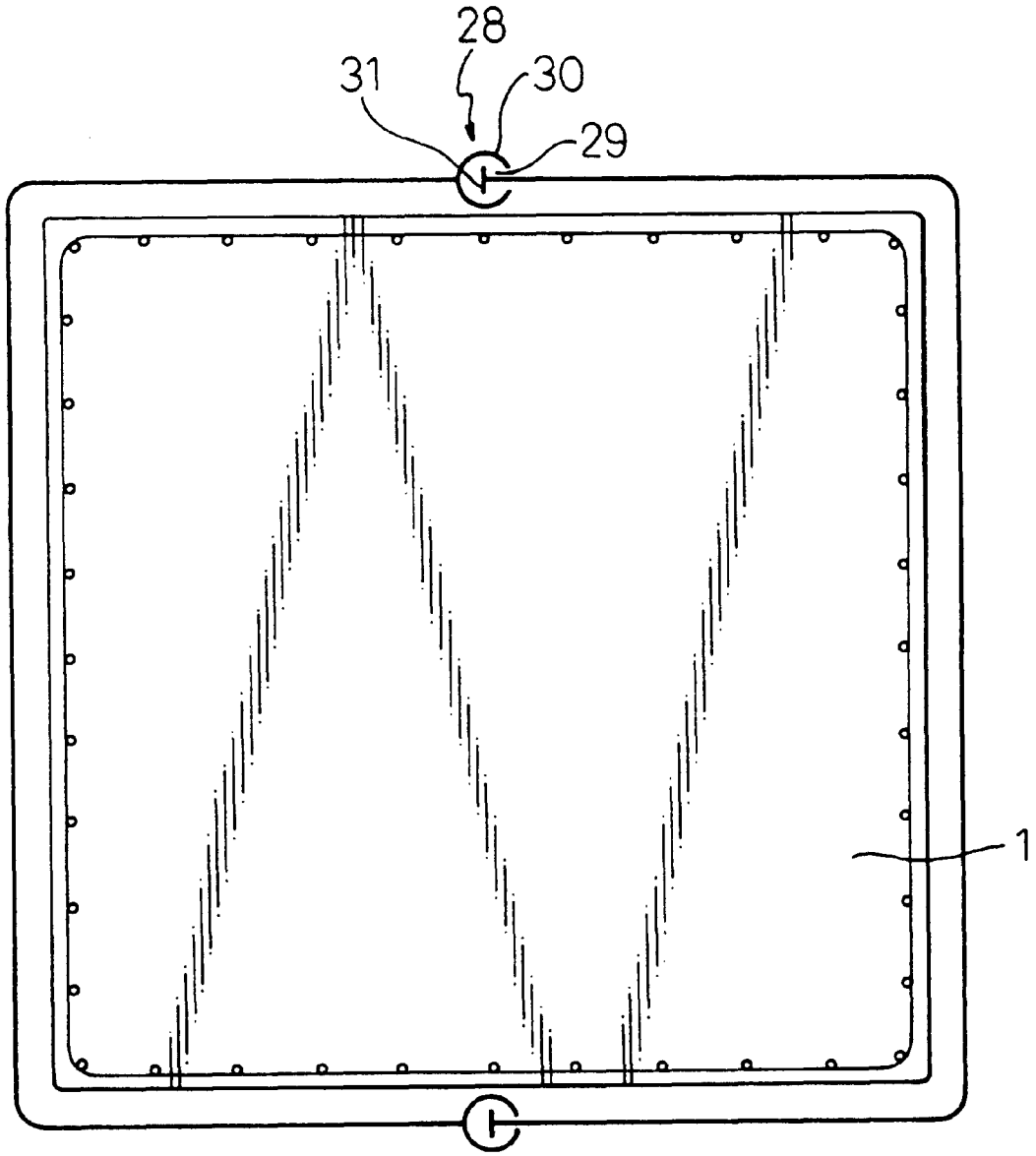
FIG. 14 is a plan view of a supplemental reinforcing structure employing the mating joint shown in FIG. 12.

FIG. 14 is a plan view of a supplemental reinforcing structure employing the mating joint 28 shown in FIG. 12. A steel plate structure included in this supplemental reinforcing structure is provided with two steel elements each formed by bending a steel sheet pile. The two steel elements are connected by the mating joints 28.

Figure 15:
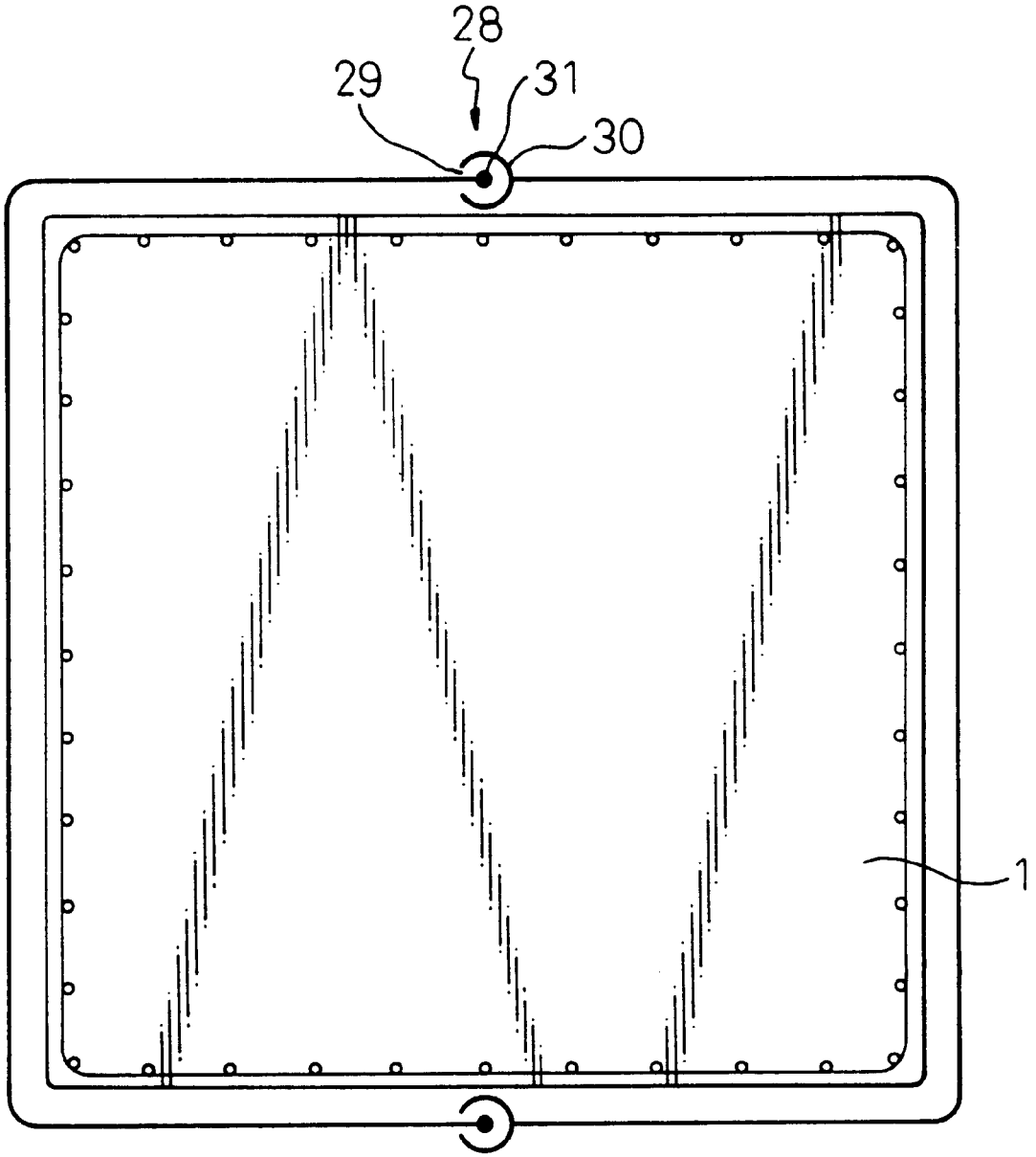
FIG. 15 is a plan view of a supplemental reinforcing structure employing a third mating joint.

FIG. 15 is a plan view of a supplemental reinforcing structure employing a third mating joint. The mating joint 28 includes a female component 30 having the shape of a pipe of a circular cross section provided with a longitudinal slit, and a male component 31 having a circular cross section. A steel plate structure included in the supplemental reinforcing structure is provided with two steel elements each formed by bending a steel sheet pile.

The components 30 and 31 of the mating joint 28 may be formed by a built-up welding process, a cutting process, a bending process, a hot pressing process or a hot rolling process. In view of forming the components 30 and 31 of the joint 28 having a high tensile strength at a low cost, a hot pressing process or a hot rolling process is desirable.

The steel elements 6 and 7 of the foregoing embodiments may be connected by a mating joint other than that concretely shown in FIG. 2 in an enlarged view.

FIG. 23 is a table of various mating joints which may be used for the present invention.

In FIG. 23, a mating joint a consists of a male component of a circular cross section, and a female component having the shape of a pipe of a circular cross section provided with a longitudinal slit.

A mating joint b consists of a male component of a T-shaped cross section, and a female component having the shape of a pipe of a rectangular cross section provided with a longitudinal slit.

A mating joint c consists of a male component of a T-shaped cross section and a female component having the shape of a pipe of a circular cross section provided with a longitudinal slit.

A mating joint d is a side seaming joint consisting of a male component formed by folding an edge portion of a steel plate, and a female component formed by bending an edge portion of a steel plate in a shape capable of receiving the male portion.

A mating joint e consists of two male components of a T-shaped cross section, and a female component having two sockets which receive the male components therein.

A mating joint f consists of two male components formed by folding the edge portions of two steel plates, and a female component having the shape of a socket of a rectangular cross section provided with a longitudinal slit.

A mating joint g consists of two components having the shape of a pipe of a circular cross section provided with a longitudinal slit.

Figure 16:
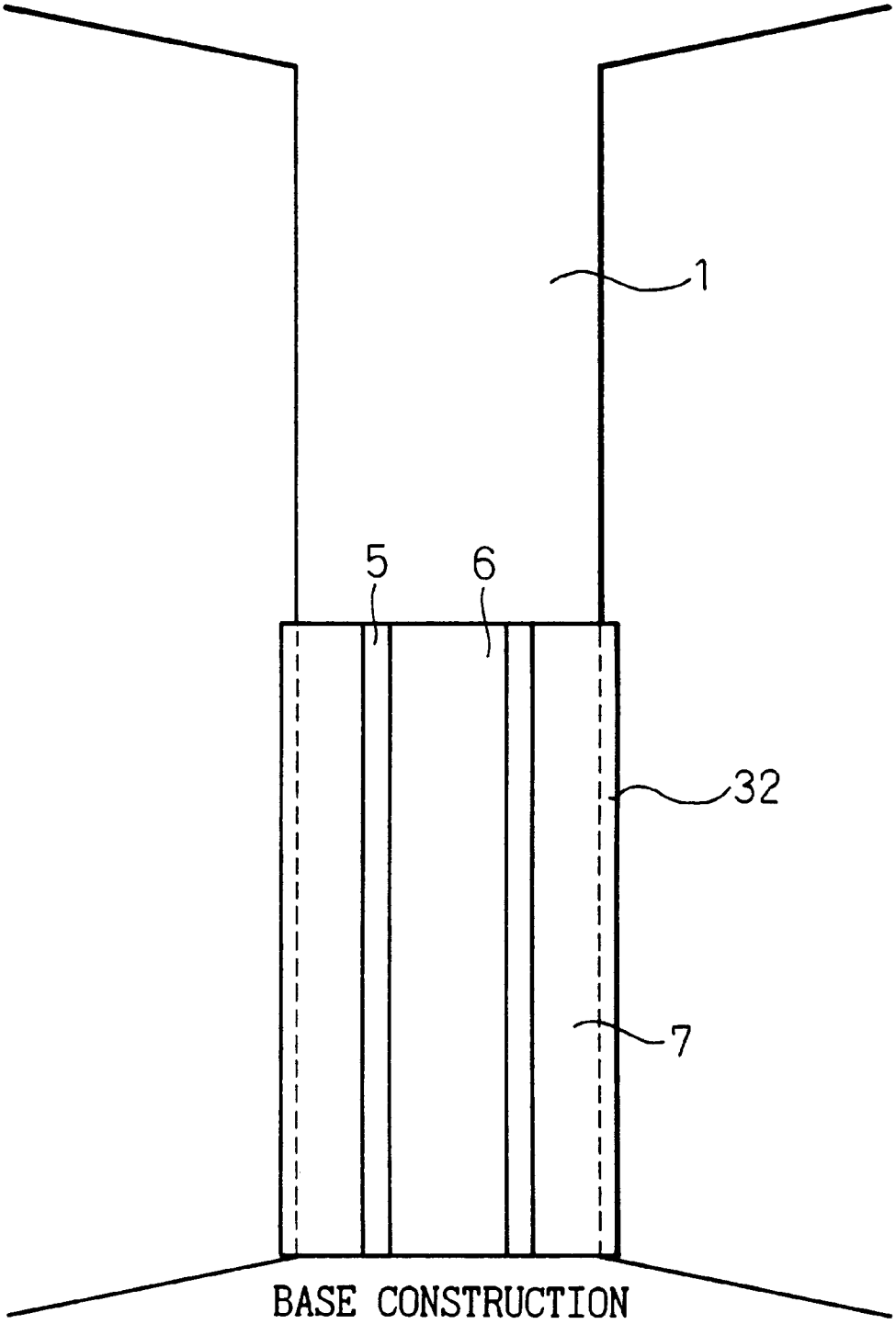
FIG. 16 is a front view of a first example of application of a supplemental reinforcing structure in accordance with the present invention to reinforcing an existing reinforced concrete pier.

FIG. 16 is a front view of a first example of an application of a supplemental reinforcing structure 32 in accordance with the present invention to reinforcing an existing reinforced concrete pier 1. The supplemental reinforcing structure 32 is set on a base construction so as to surround a lower portion of the reinforced concrete structure 1 set on the base construction.

Figure 17:
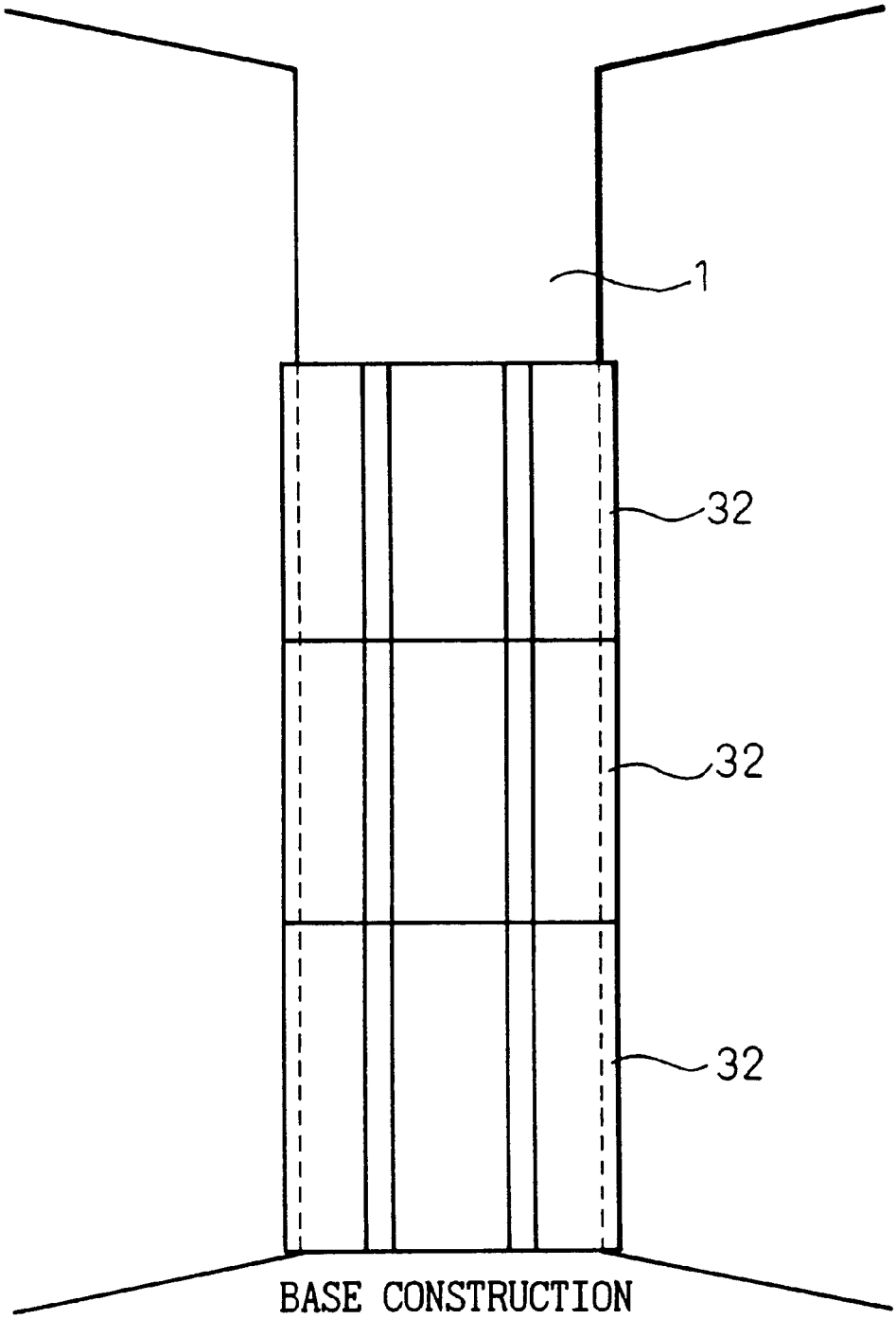
FIG. 17 is a front view of a second example of application of a supplemental reinforcing structure in accordance with the present invention to reinforcing an existing reinforced concrete pier.

FIG. 17 is a front view of a second example of an application of a supplemental reinforcing structure 32 in accordance with the present invention to reinforcing an existing reinforced concrete pier 1. A plurality of supplemental reinforcing structures 32 (three supplemental reinforcing structures 32) are stacked on a base construction so as to surround the reinforced concrete pier 1 set on the base construction.

Figure 18:
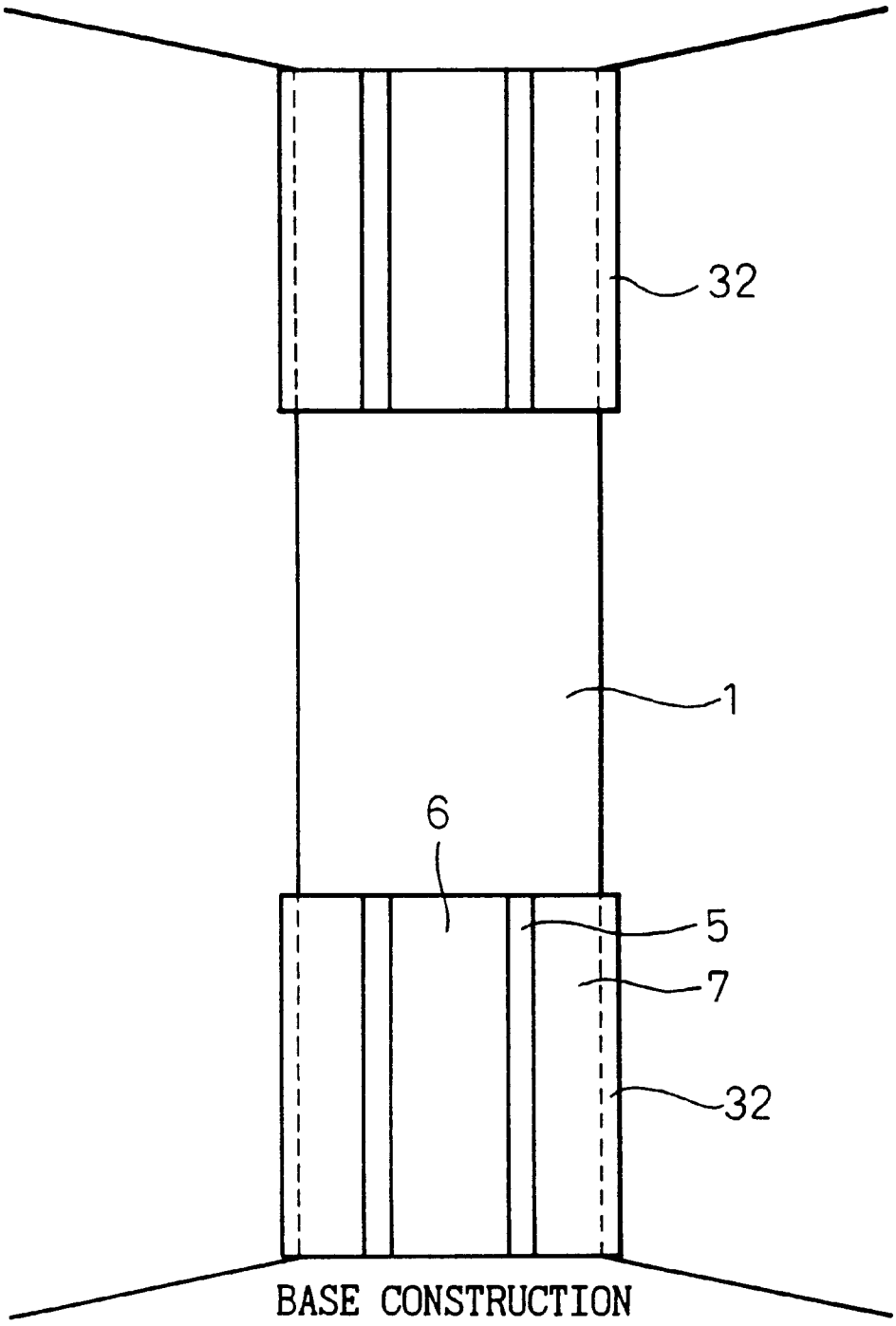
FIG. 18 is a front view of a third example of application of a supplemental reinforcing structure in accordance with the present invention to reinforcing an existing reinforced concrete pier.

FIG. 18 is a front view of a third example of an application of a supplemental reinforcing structure 32 in accordance with the present invention to reinforcing an existing reinforced concrete pier 1. Two supplemental reinforcing structures 32 are constructed so as to surround an upper end portion and a lower end portion, respectively, of the reinforced concrete pier 1.

Figure 19:
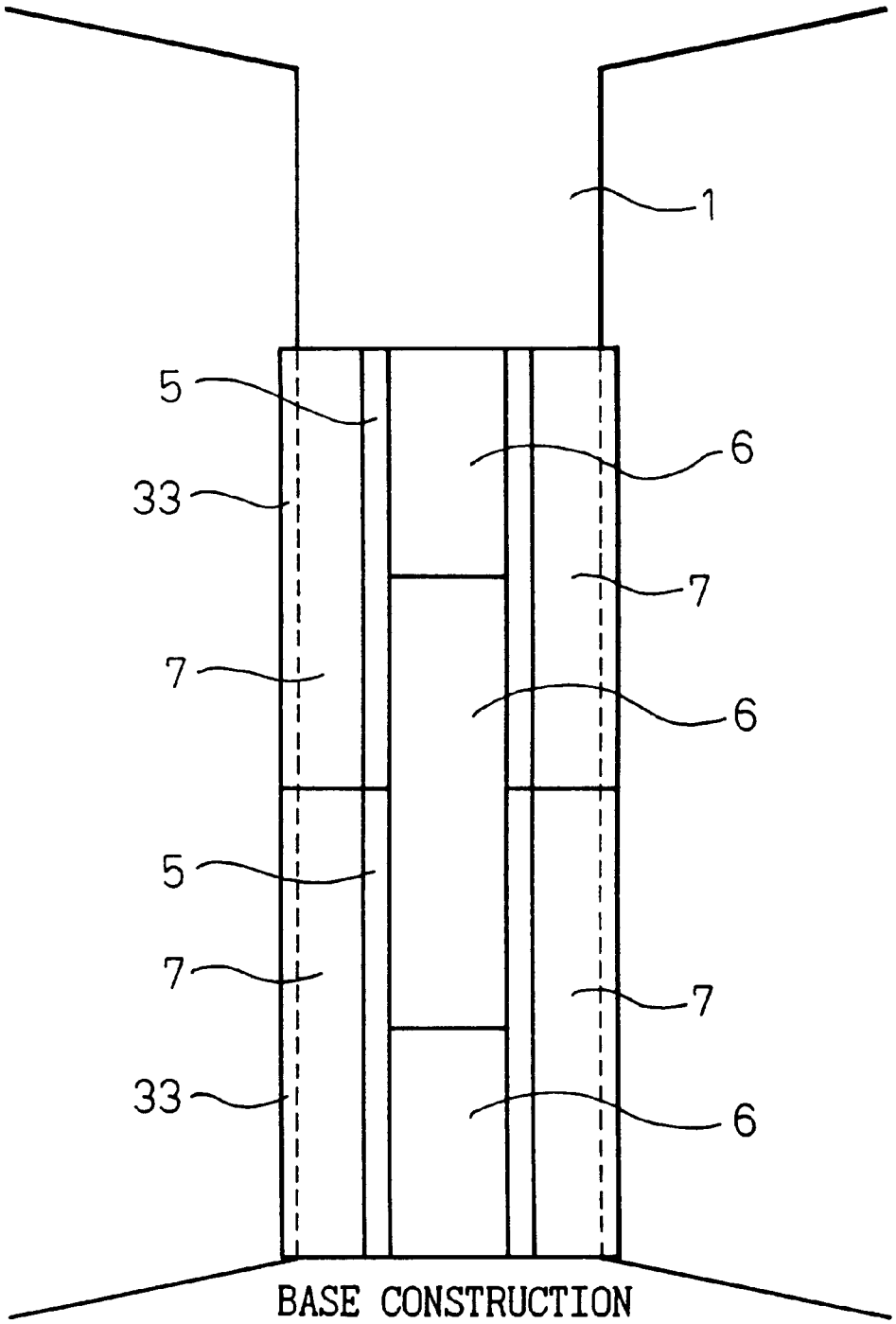
FIG. 19 is a front view of a fourth example of application of a supplemental reinforcing structure in accordance with the present invention to reinforcing an existing reinforced concrete pier.

FIG. 19 is a front view of a fourth example of an application of a supplemental reinforcing structure 33 in accordance with the present invention to reinforcing an existing reinforced concrete pier 1. Two supplemental reinforcing structures 33 having flat steel elements 6 and angular steel elements 7 in an alternate circumferential arrangement are stacked on a base construction so as to surround a lower portion of the reinforced concrete pier 1 set on the base. The flat steel elements 6 are displaced longitudinally relative to the angular steel elements 7 so that each flat steel element 6 extends across the two adjacent supplemental reinforcing structures 33. This arrangement of the flat steel elements 6 and the angular steel elements 7 prevents the supplemental reinforcing structures 33 from displacement relative to each other.

Figure 20:
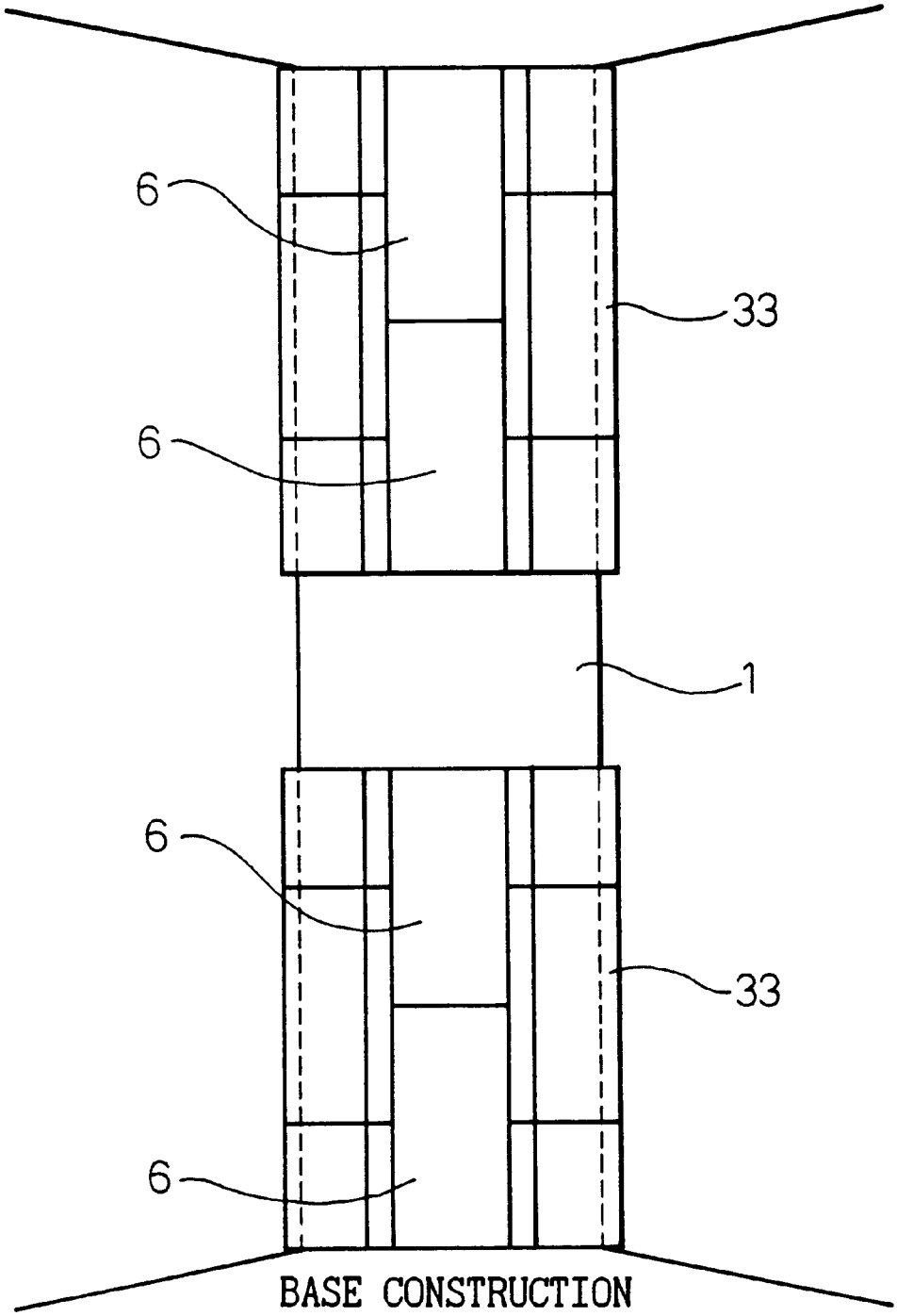
FIG. 20 is a front view of a fifth example of application of a supplemental reinforcing structure in accordance with the present invention to reinforcing an existing reinforced concrete pier.

FIG. 20 is a front view of a fifth example of an application of a supplemental reinforcing structure 33 in accordance with the present invention to reinforcing an existing reinforced concrete pier 1. Two sets of supplemental reinforcing structures 33 similar to that of the two supplemental reinforcing structures 33 shown in FIG. 19 are formed so as to surround an upper end portion and a lower end portion, respectively, of the reinforced concrete pier 1 set on a base construction.

Figure 21:
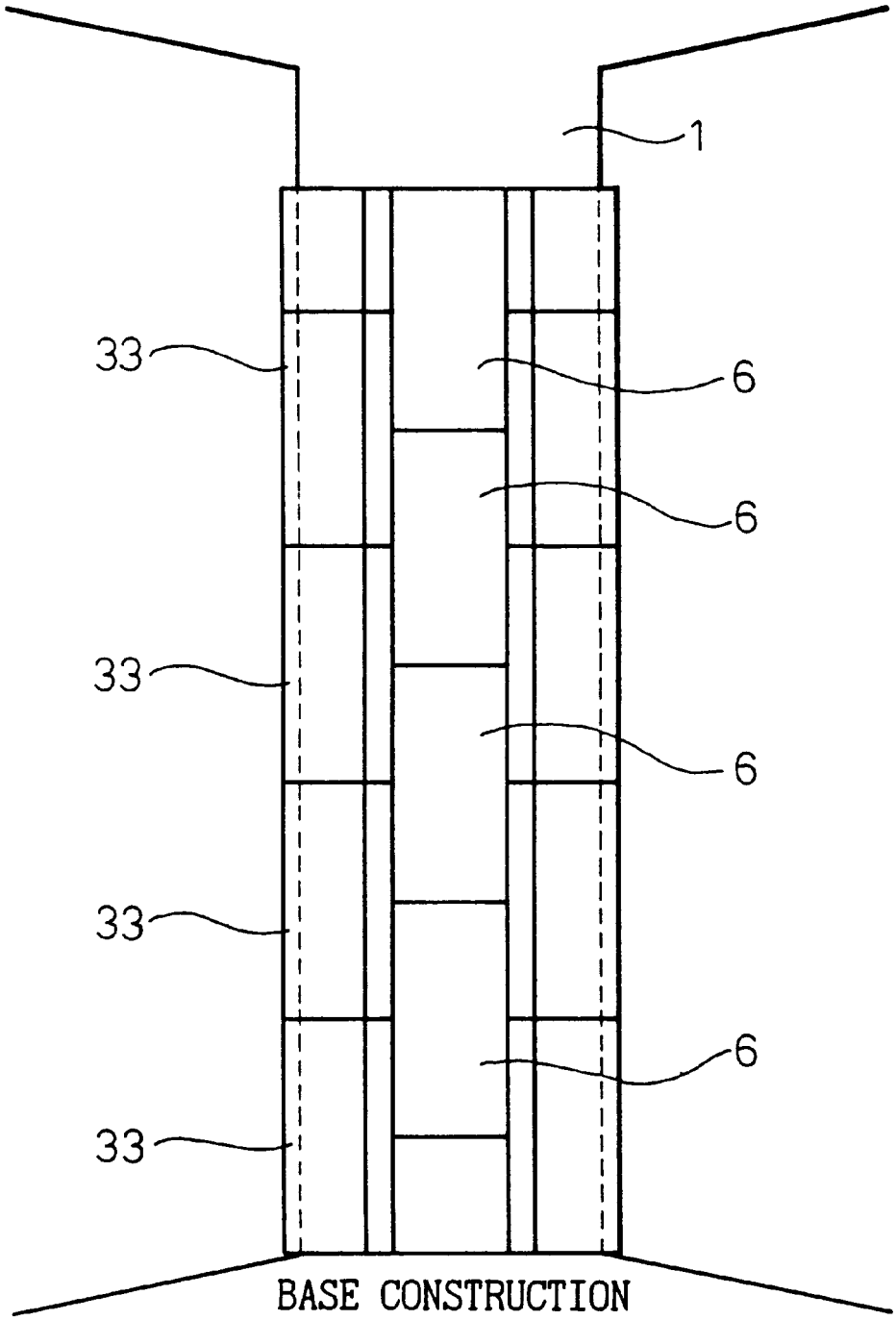
FIG. 21 is a front view of a sixth example of application of a supplemental reinforcing structure in accordance with the present invention to reinforcing an existing reinforced concrete pier.

FIG. 21 is a front view of a sixth example of an application of a supplemental reinforcing structure 33 in accordance with the present invention to reinforcing an existing reinforced concrete pier 1. A plurality of supplemental reinforcing structures 33 (four supplemental reinforcing structures 33) similar to those shown in FIG. 19 are stacked on a base so as to surround the reinforced concrete pier 1 set on the base construction.

Figure 22:
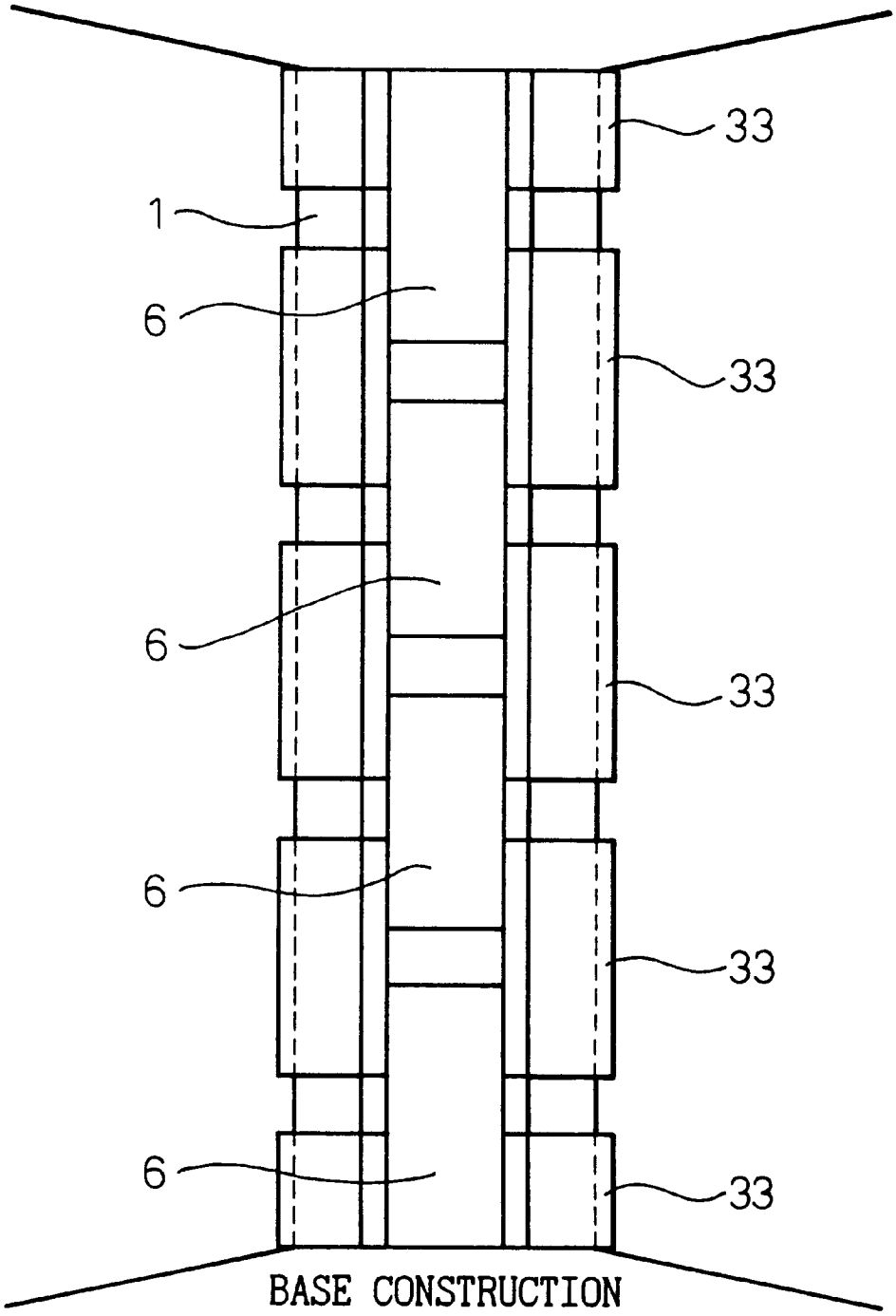
FIG. 22 is a front view of a seventh example of application of a supplemental reinforcing structure in accordance with the present invention to reinforcing an existing reinforced concrete pier.
Figure 24:
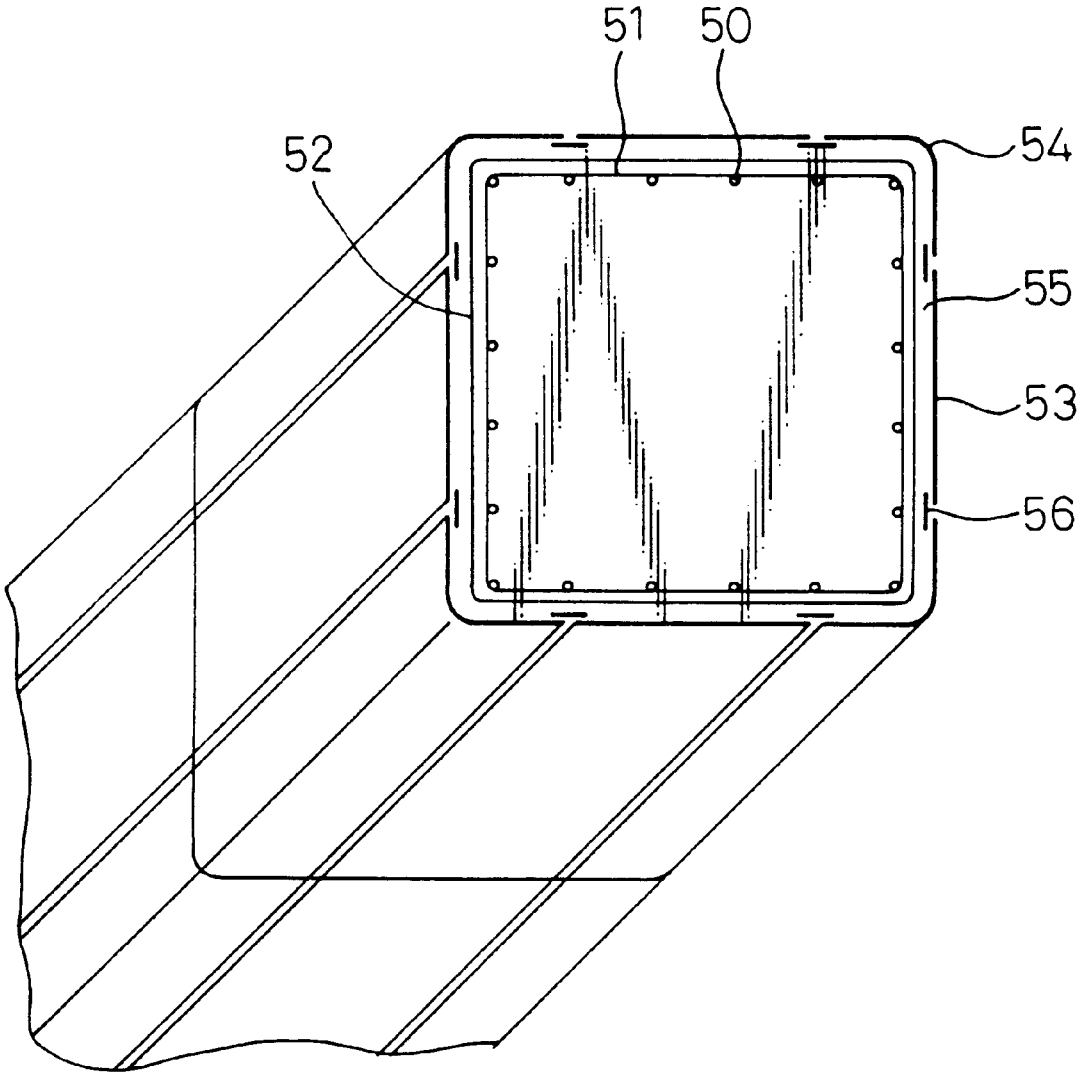
Fig. 24 PRIOR ART
FIG. 24 is a perspective view of a conventional supplemental reinforcing structure for reinforcing an existing reinforced concrete pier.

FIG. 22 is a front view of a seventh example of an application of a supplemental reinforcing structure 33 in accordance with the present invention to reinforcing an existing reinforced concrete pier 1. A plurality of supplemental reinforcing structures 33 similar to those shown in FIG. 19 are arranged longitudinally at intervals between the upper end and the lower end of the reinforced concrete pier 1 so as to entirely surround the reinforced concrete pier 1 set on a base construction.

The steel plate structure included in each of the supplemental reinforcing structures in the foregoing embodiments according to the present invention is constructed by connecting steel elements each having mating edge portions. The steel plate structure can easily be constructed on site and simplifies field work. Since the mating edge portions can be mechanically joined together without requiring welding, time and labor necessary for the field work can be reduced, and the quality and reliability of the field work are improved greatly.

The effect of the present invention is particularly obvious when the components of the steel plate structure are made of a steel which is difficult to weld satisfactorily, such as a corrosion-resistant steel or a high-strength steel.

The steel plate structure may be constructed by assembling surface-treated steel components, such as plated steel components, coated steel components or corrosion-proofed steel components, because the joints of the steel plate structure can be formed without requiring welding and hence pretreatment and posttreatment which are necessary before and after welding if surface-treated steel components are used are not necessary. Thus, the present invention facilitates field work and reduces costs.

Since the steel elements are steel sheet piles, the quantity of secondary work for processing the steel components is reduced and further rationalization can be achieved.

If the steel plate structure is constructed by connecting the steel elements in a zigzag arrangement, the supplemental reinforcing structures can be prevented from displacement relative to each other, circumferential tensile load is distributed evenly to the upper and the lower supplemental reinforcing structure, so that the supplemental reinforcing structures can further be strengthened.

Since the joints between the steel elements are pretensioned to an extent which eliminates a joint clearance and does not reduce the rigidity before filling up the space between the reinforced concrete pier and the supplemental reinforcing structure with the freely formable hardening material and hardening the same, a supplemental reinforcing structure with high reliability can be constructed.

What I claim is:

1. A supplemental reinforcing structure to be wrapped around a reinforced concrete pier to reinforce the reinforced concrete pier, comprising:

a circumferential tensile force earthquake load bearing closed steel plate structure constructed by mechanically connecting adjacent steel elements having adjacent mechanical joint mating edge portions by mechanically joining together said adjacent mechanical joint mating edge portions so as to surround said reinforced concrete pier with a space formed between said reinforced concrete pier and said closed steel plate structure; and a freely formable hardening material filling, and hardened in, said space between said reinforced concrete pier and said closed steel plate structure;

said supplemental reinforcing structure further comprising:

two steel plate structures stacked one on top of the other with the alternate steel elements displaced relative to the others so that said alternate steel elements extend across the two steel plate structures.

2. The supplemental reinforcing structure according to claim 1, wherein said reinforced concrete pier has a rectangular cross section, and wherein said steel elements include flat steel elements for covering flat surfaces of said reinforced concrete pier, and angular steel elements having a shape substantially resembling an angle iron, for covering edge portions of said reinforced concrete pier.

3. The supplemental reinforcing structure according to claim 1, wherein said freely formable hardening material comprises at least one of mortar and concrete.

4. The supplemental reinforcing structure according to claim 1, wherein said steel elements having the mating edge portions are made of a corrsion-resistant metal material.

5. The supplemental reinforcing structure according to claim 1, wherein said steel elements having said mating edge portions are formed by processing surface-treated metallic plates.

6. The supplemental reinforcing structure according to claim 5, wherein said surface-treated metallic plates are steel plates having surfaces finished by a corrosion-resistant surface treatment.

7. The supplemental reinforcing structure according to claim 1, wherein each of said steel elements having said mating edge portions comprises a halved steel sheet pile having a mating edge portion thereof, and a steel plate, said halved steel sheet pile serving as a component of a mating joint.

8. The supplemental reinforcing structure according to claim 1, wherein all the steel elements having said mating edge portions thereof are steel sheet piles.

* * * * *